US007142688B2

(12) United States Patent
Croft, III et al.

(10) Patent No.: US 7,142,688 B2
(45) Date of Patent: Nov. 28, 2006

(54) SINGLE-ENDED PLANAR-MAGNETIC SPEAKER

(75) Inventors: James J. Croft, III, Poway, CA (US); David Graebener, Carson City, NV (US)

(73) Assignee: American Technology Corporation, San Diego ( * ) Notice: Subject to any disclaimer, the term of this patent is extended or adjusted under 35 U.S.C. 154(b) by 753 days.

(21) Appl. No.: 10/055,821

(22) Filed: Jan. 22, 2002

(65) Prior Publication Data

US 2002/0191808 A1 Dec. 19, 2002

Related U.S. Application Data

(60) Provisional application No. 60/263,480, filed on Jan. 22, 2001.

(51) Int. Cl.
*H04R 25/00* (2006.01)

(52) U.S. Cl. ..... 381/431; 381/176; 381/399

(58) Field of Classification Search ..... 381/423, 381/431, 401, 408, 176–177, 152, 190–191, 381/395–396, 398–399
See application file for complete search history.

(56) References Cited

U.S. PATENT DOCUMENTS

| | | | |
|---|---|---|---|
| 1,764,008 | A | 6/1930 | Crozier |
| 1,799,053 | A | 3/1931 | Mache |
| 1,809,754 | A | 6/1931 | Steedle |
| 1,951,669 | A | 3/1934 | Ramsey |
| 1,983,377 | A | 12/1934 | Kellogg |
| 2,461,344 | A | 2/1949 | Olson |
| 2,855,467 | A | 10/1958 | Curry |
| 2,935,575 | A | 5/1960 | Bobb |
| 2,975,243 | A | 3/1961 | Katella |
| 2,975,307 | A | 3/1961 | Schroeder et al. |
| 3,008,013 | A | 11/1961 | Williamson et al. |
| 3,012,222 | A | 12/1961 | Hagemann |
| 3,136,867 | A | 6/1964 | Brettell |
| 3,141,071 | A | 7/1964 | Rich |
| 3,345,469 | A | 10/1967 | Rod |
| 3,389,226 | A | 6/1968 | Peabody |

(Continued)

FOREIGN PATENT DOCUMENTS

JP H2-265400 10/1990

(Continued)

OTHER PUBLICATIONS

Ultrasonic Ranging System by Polaroid Corporation.

(Continued)

*Primary Examiner*—Suhan Ni
(74) *Attorney, Agent, or Firm*—Thorpe North & Western LLP

(57) ABSTRACT

A planar-magnetic electro-acoustic transducer including a support structure and a magnetic structure carried by the support structure, the magnetic structure comprising a multiplicity of high-energy magnets configured so as to have shared loop field maxima and local loop field maxima, and a diaphragm carried by the support structure, comprising a plurality of conductors carried by and coupled to the diaphragm, said conductors being disposed in relation to local loop maxima and configured to exploit the energy of local loop maxima, as well as the energy of shared loop maxima in driving the diaphragm to produce an acoustic output; and the magnetic structure can be configured so that it includes magnet rows, and the transverse cross-sectional width of the magnets does not exceed their transverse cross-sectional height, and the distance between adjacent elongated magnet rows is greater than one half the width of either of the magnets of the adjacent magnet rows.

62 Claims, 10 Drawing Sheets

U.S. PATENT DOCUMENTS 3,398,810 A 8/1968 Clark, III
3,654,403 A 4/1972 Bobb
3,674,946 A 7/1972 Winey
3,787,642 A 1/1974 Young, Jr.
3,821,490 A 6/1974 Bobb
3,829,623 A 8/1974 Willis et al.
3,833,771 A 9/1974 Collinson
3,836,951 A 9/1974 Geren et al.
3,873,784 A 3/1975 Doschek
3,892,927 A 7/1975 Lindenberg
3,919,499 A 11/1975 Winey
3,922,504 A 11/1975 Kishikawa et al.
3,941,946 A 3/1976 Kawakami et al.
3,997,739 A 12/1976 Kishikawa et al.
4,056,742 A 11/1977 Tibbetts
4,064,375 A 12/1977 Russell et al.
4,156,801 A 5/1979 Whelan et al.
4,160,882 A 7/1979 Driver
4,207,571 A 6/1980 Passey
4,210,786 A 7/1980 Winey
4,228,327 A 10/1980 Sawafuji
4,242,541 A 12/1980 Ando
4,245,136 A 1/1981 Krauel, Jr.
4,284,921 A 8/1981 Lemonon et al.
4,289,936 A 9/1981 Civitello
4,295,214 A 10/1981 Thompson
4,378,596 A 3/1983 Clark
4,385,210 A 5/1983 Marquiss
4,418,404 A 11/1983 Gordon et al.
4,419,545 A 12/1983 Kuindersma
4,429,193 A 1/1984 Busch-Vishniac et al.
4,434,327 A 2/1984 Busch-Vishniac et al.
4,439,642 A 3/1984 Reynard
4,471,172 A 9/1984 Winey
4,480,155 A 10/1984 Winey
4,491,698 A 1/1985 Larson
4,544,806 A 10/1985 Nieuwendijk
4,550,228 A 10/1985 Walker et al.
4,558,184 A 12/1985 Busch-Vishniac et al.
4,593,160 A 6/1986 Nakamura
4,593,567 A 6/1986 Isselstein et al.
4,672,591 A 6/1987 Breimesser et al.
4,695,986 A 9/1987 Hossack
4,703,510 A 10/1987 Larson
4,751,419 A 6/1988 Takahata
4,803,733 A 2/1989 Carver et al.
4,823,908 A 4/1989 Tanaka et al.
4,837,838 A 6/1989 Thigpen et al.
4,885,781 A 12/1989 Seidel
4,887,246 A 12/1989 Hossack et al.
4,888,086 A 12/1989 Hossack et al.
4,903,703 A 2/1990 Igarashi et al.
4,908,805 A 3/1990 Sprenkels et al.
4,924,504 A 5/1990 Burton
4,991,148 A 2/1991 Gilchrist
5,003,610 A * 3/1991 Adachi et al. ..... 381/431
5,021,613 A 6/1991 Garcia
5,054,081 A 10/1991 West
5,142,511 A 8/1992 Kanai et al.
5,153,859 A 10/1992 Chatigny et al.
5,287,331 A 2/1994 Shindel et al.
5,357,578 A 10/1994 Taniishi
5,392,358 A 2/1995 Driver
5,430,805 A 7/1995 Stevenson et al.
5,684,884 A 11/1997 Nakaya et al.
5,850,461 A 12/1998 Zelinka
5,901,235 A 5/1999 Thigpen et al.
5,953,438 A 9/1999 Stevenson et al.
5,961,762 A 10/1999 Zelinka et al.
6,104,825 A 8/2000 Thigpen
6,137,891 A 10/2000 Porrazzo et al.
6,188,772 B1 2/2001 Norris et al.

FOREIGN PATENT DOCUMENTS

WO WO 00/41492 7/2000
WO WO 91/08449 2/2001
WO WO 01/52437 7/2001

OTHER PUBLICATIONS

Parametric Loudspeaker —Characteristics of Acoustic Field and Suitable Modulation of Carrier Ultrasound, Aoki, Kenichi, Kamakura, Tomoo and Kumamoto, Yoshiro, Electronics and Communications in Japan, Part 3, vol. 74, No. 9, pp. 76-82 (1991).

Parametric Acoustic Nondirectional Radiator, Makarov, et al, Acustica, vol. 77, pp. 240-242 (1992).

The Audio Spotlight: An Application of Nonlinear Interaction of Sound Waves to a New Type of Loudspeaker Design, Yoneyama, et al, J. Acoustical Society of America 73(5), May 1983, pp. 1532-1536.

Electrostatic Loudspeaker Design and Construction, Chapters 4 and 5, pp. 59-91, Wagner, Ronald, Audio Amateur Press Publishers, 1993.

* cited by examiner

SINGLE-ENDED PLANAR-MAGNETIC SPEAKER

This application claims priority of U.S. provisional application Ser. No. 60/263,480, filed Jan. 22, 2001, which is hereby incorporated herein by reference for the teachings consistent herewith, and this disclosure shall control in case of inconsistency.

BACKGROUND OF THE INVENTION

1. Field of the Invention

The present invention relates generally to improvements in fringe-field planar-magnetic speakers; and, more particularly, to fringe-field planar-magnetic speakers with single-ended primary magnetic circuits.

2. Background

Two general fields of loudspeaker design comprise (i) dynamic, cone devices and (II) electrostatic thin-film devices. A third, heretofore less exploited area of acoustic reproduction technology is that of thin-film, fringe-field, planar-magnetic speakers. This third area represents a bridging technology between these two previously recognized general areas of speaker design; combining a magnetic motor of an electro dynamic/cone transducer with a film-type diaphragm of a electrostatic device. However, it has not produced conventional planar-magnetic transducers, which, as a group, have achieved a significant level of market acceptance over the past 40-plus years of evolution. Indeed, planar-magnetic speakers currently comprise well under 1% of the total loudspeaker market. It is a field of acoustic technology that has remained exploratory, and embodied only in a limited number of relatively high-priced commercial products over this time period.

As with market acceptance of any speaker, competitive issues are usually controlling. In addition to providing performance and quality, a truly competitive speaker must be reasonable in price, practical in size and weight, and must be robust and reliable. Assuming that two different speakers provide comparable audio output, the deciding factors in realizing a successful market penetration will usually include price, convenience, and aesthetic appearance. Price is primarily a function of market factors, such as cost of materials and assembly, perceived desirability from the consumer's standpoint (as distinguished from actual quality and performance), demand for the product, and supply of the product. Convenience embodies considerations of adaptation of the product for how the speaker will be used, such as mobility, weight, size, and suitability for a customer-desired location of use. Finally, the aesthetic aspects of the speaker will also be of consumer interest; including considerations of appeal of the design, compatibility with decor, size, and simply its appearance in relation to the surroundings at the point of sale and at the location of use. If planar-magnetic speakers can be advanced so as to compare favorably with conventional electro dynamic and electrostatic speakers in these areas of consideration, further market penetration can be possible; as reasonable consumers should adopt the product that provides the most value for the purchase price paid.

With this background, a discussion of the relative successes and failures of conventional planar-magnetic speakers, and design goals and desired traits of operation will be given. It is interesting to note that the category of fringe-field, planar-magnetic speakers has evolved around two basic categories: a)"single-ended"; and, b) symmetrical "double-ended" designs, the later sometimes being called "push-pull," and both will be touched on as background for discussion of single-ended designs.

A conventional push-pull device is illustrated in FIG. 1. This structure is characterized by two magnetic arrays, 10 and 11, each supported by perforate substrates 14, 24; and positioned on opposite sides of a flexible diaphragm 12 which includes a conductive coil 13. The film is tensioned into a planar configuration. An audio signal is supplied to the coil 13, and a variable voltage thereby provided in the coil interacts with the otherwise fixed magnetic field between the magnet arrays 10 and 11. The diaphragm is displaced in accordance with variations in the audio signal, thereby generating a desired acoustic output. A representative example can be found in the disclosure of U.S. Pat. No. 4,156,801 issued to Whelk.

Because of a doubled-up, front/back magnet layout of prior push-pull planar-magnetic transducer structures, these double-ended systems have been generally regarded as more efficient, but as more complex to build. Also, they have certain performance limitations stemming from the formation of cavity resonances derived from the passage of sound waves through the cavities, or channels 16 formed by the spaces between the magnets of the arrays 10, 11, and acoustically radiating to the external environment through holes 15 in the substrates 14, 24. This can cause problems at certain frequencies, including giving rise to resonant peaks and band-limiting attenuation. In all fairness it must be said that single-ended designs are not immune from this problem; and particularly where the magnet spacing is close together, cavity resonances can occur in single-ended as well as double-ended designs.

Double-ended designs are also particularly sensitive to deformation from repulsive magnetic forces, which tend to deform the structures of such devices outward. This outward bowing draws the edges of the diaphragm closer together and alters the tension on the diaphragm. This can significantly degrade performance, to the point of rendering the speaker unusable.

As mentioned, a second category of planar-magnetic speakers comprises single-ended devices. With reference to FIG. 2, a typical conventional single-ended speaker configuration, having a flexible diaphragm 17 with a number of conductive elements 18, is set forth by way of example. The diaphragm is tensioned and supported by frame members (not shown) carried by a substrate 19 of the frame, and which frame members extend outward (upward in the figure) beyond the top of a single array of magnets 35 to position the diaphragm an offset distance away from the tops of the magnets to accommodate vibration of the diaphragm. The array provides a fixed magnetic field with respect to the coil conductors 18 disposed on the diaphragm. It will be apparent that the single array of magnets (typically of ceramic or rubberized ferrite composition) provides a much-reduced energy field, compared to the previously discussed push-pull device, assuming comparable magnets are used. Because of this and other reasons, previous single-ended devices of compact size have not provided performance that has been deemed acceptable for commercial applications.

Furthermore, conventional single-ended devices have had to be quite large to work effectively; and, even so, are less efficient than standard electrostatic and electro dynamic loudspeaker designs mentioned above. Small, or even average-sized single-ended planar-magnetic devices (compared to electro dynamic and electrostatic speakers) have not effectively participated in the loudspeaker market in the time since the introduction of planar magnetic speakers. Comparatively large devices, generally greater than 300 square inches, have been available to consumers in the speaker market; and these exhibit limited competitiveness. That is to say, they are on par with standard speakers in terms of acceptance, suitability to certain applications, cost, and performance. But again, the market penetration of planar-magnetic speakers is less than 1%, including both single-ended and push-pull devices. Prior single-ended planar-magnetic devices with such large diaphragm areas require correspondingly relatively large and expensive structures; and, such relatively larger speakers can be cumbersome to place in some environments. They have relatively low efficiencies as well, compared with electro dynamic and electrostatic speakers, requiring more powerful, and hence more expensive, amplifiers to provide adequate signal power to drive them.

At first impression, a single-ended device might appear to be simpler and cheaper to build than a double-ended design. The same amount of magnet material can be used by doubling the thickness of the magnets to correspond to the combined thickness of a double-ended array of magnets. Because magnets of a given material made twice as thick are cheaper installed than twice as many magnets half as thick (as in a double-ended device) there should be significant savings in a single-ended configuration. Furthermore, the structural complexity is significantly less with regard to single-ended designs, further adding to expected cost savings.

However, doubling the depth of the magnets from that of most designs does not achieve the expected design goal of providing twice the magnetic energy in the gap between the diaphragm and the array of magnets when using conventional ferrite magnets. Accordingly, the expectation for lower cost per a given performance level in the single-ended device has not been realized. Some attempts to improve the design of single-ended planar-magnetic devices have involved the use of relatively many more, and very closely spaced, magnets to provide sufficiently high magnetic field energy. Even then, however, the planar area must be very large, using even more magnets to generate enough sensitivity and acoustic output. For at least these reasons, prior attempts to develop a commercially acceptable single-ended planar-magnetic device have not achieved the desired lower cost for comparable performance design goals. This is true even though the basic form of their structure would seem to be simpler than push-pull devices. And again, the design has not obviated the need for a large surface area and therefore a large device compared with most other speaker types.

Moreover, the architecture of the double-ended planar-magnetic loudspeaker is quite different from that of a single-ended design. For example, the magnetic circuits of the front and back magnetic structures interact, and require a different set of design parameters, e.g. Spacing, field energy, and spatial relationships between the essential elements, to be optimized for best results. Very few of those interactive relationships are transferable in relation to design of single-ended transducers, which have their own unique set of optimal relationships between the essential elements involved.

As mentioned, prior planar-magnetic speakers, particularly prior art single-ended devices, have utilized rows of magnets placed closely, side-by-side to provide improved performance. The magnets are oriented so as to have alternating polarities facing the film diaphragm 17, which carries conductive wires or strips 18 placed conventionally so as to be substantially centered between adjacent magnets. Such prior devices further illustrate that the magnetic field energy to be interacted with by the variable fields set up by the variably energized conductive strips is a shared magnetic field with lines of force arcing between adjacent magnets. In such prior devices, the available magnetic force to be exploited is assumed to be at a maximum at a point half way between two adjacent magnets of opposite polarity orientation; and correspondingly, centered placement of the conductive strips in the field at that location is typical. To achieve sufficient flux density at the position centered between the magnets, it has been shown that (i) not only does the total size of the system need to be increased; but, (II) the magnet placement must be much closer together and more plentiful in a single-ended device than in a push-pull planar-magnetic transducer.

Further, in contrast with standard, dynamic cone-type speakers, thin film planar loudspeakers have a critical parameter that must be optimized for proper functionality. The parameter is film diaphragm tension (See, for example, U.S. Pat. No. 4,803,733 to Carver). Proper, consistent, and long-term stable tensioning of the diaphragm in a planar device is very important to the performance of the loudspeaker. This has been a problematic area of consideration for thin-film planar devices for many years, and it is a problem in design and manufacture for current thin-film devices. Even the most carefully adjusted device can meet short-term requirements, but still can still have long-term problems with tension changes due, for example, to the dimensional instability of the diaphragm material and/or diaphragm mounting structure. Compounding this problem is force interaction within the magnet array and the supporting structure. Due to close magnet spacing of single-ended magnetic structures, the magnetic forces of the adjacent rows of magnets can interact and attract/repel each other to a greater or lesser degree depending upon the polarity relationship of the magnets and their spacing. The interaction over time can cause materials to deform; and impose changes on the film tension. This can degrade the performance of the speakers over time.

Electrostatic loudspeakers have critical diaphragm tension issues, but they do not have magnetic forces working to change the tension in the same way or to the same degree. Dynamic cone-type speakers have magnetic coil transducers and strong related forces, but do not utilize tensioned diaphragms. Planar-magnetic speakers, and particularly single-ended configurations, pose unique challenges with respect to long-term stability for diaphragm tensioning.

With conventional planar-magnetic speakers an increase in magnetic energy derived by increasing the number, or the strength, or both, of the magnets in the magnetic structure further exacerbates the problem of magnetic forces interference with calibrated film tension. Per the foregoing, this is true particularly over time. These and other problems are known to many practitioners in the art. Another example of a prior art single-sided planar-magnetic device, which further illustrates some of these issues, is set forth in U.S. Pat. No. 3,919,499 to Winey.

Turning now to more particular consideration of the magnets themselves, the selection of proper magnets for planar-magnetic speakers is an important consideration. High-energy neodymium magnets have been available for over ten years, and have been used in electro dynamic cone-type speakers. As will be appreciated, however, such speakers do not employ magnetic material structures and supporting structures to support the magnets and at the same time maintain a tension on a nominally flat diaphragm that can be influenced by the magnets. Such relatively more high-energy neodymium magnets have not been effectively applied to single-ended planar-magnetic transducers over this past decade wherein they have been widely available. This is true even though there has been a great need for an improved magnetic circuit to enhance speaker output and reduce size.

One possible explanation for this is that practitioners in planar-magnetic speaker technologies already have difficulty with the critical aspect of diaphragm tensioning. As mentioned, not only is it necessary to achieve a proper initial diaphragm position and tension, but that this configuration must be maintained over years of use, despite inter-magnetic forces, tension forces, and stress arising during dynamic vibration of the diaphragm, all of which can deform supporting and stabilizing structure materials. These factors affect dimensional stability of such structure, as they are constantly working over time to change the magnet positioning and structural frame shapes, such that the diaphragm tension and a magnet-to-diaphragm distance can be influenced. Over a relatively short or long period of time, this tends to un-calibrate the diaphragm tension and degrade the performance of the speaker. It only takes a change of a fraction of a millimeter to significantly alter the performance of a thin-film planar-magnetic loudspeaker. Since this problem is already pivotal in the performance and lifetime reliability of planar-magnetic transducers, exacerbating the problem further with use of magnets having 5 to 40 times the interactive forces would not appear likely to function reliably as a substitution for conventional magnets which already destabilize in the lower-energy magnetic fields used in single-ended planar-magnetic loudspeakers in the current state of the art.

With current magnetic structure designs of single-ended planar-magnetic loudspeakers having the very close side-to-side spacing, as compared to double-ended designs mentioned above, a perceived problem with high-energy magnets is that the attractive forces of the magnets would appear to be too intense; to a point of not only potentially distorting the structure, and affecting diaphragm tension, but even affecting the stability of existing magnet attachment means. For at least these potential reasons, such high-strength magnets have not been successfully used in a commercial planar-magnetic design.

Another difficulty with conventional single-ended planar magnet loudspeaker designs is that of low-frequency range distortion. Since most commercial planar-magnetic speakers do not provide the extended low-frequency performance of a dedicated sub woofer, there has been a need for integrating the planar loudspeaker with a sub woofer in an audibly seamlessly fashion. Due to relatively poor damping of prior-art planar-magnetic loudspeakers, more particularly single-ended ones, there have been high "Q" resonances at the low frequency end of the planar-magnetic system response range, which is at or near the transition frequency to a sub woofer. Because of this discontinuity, the audible result is often poor, with clearly detectable adverse coloration of the sound due to this problem. For at least this reason, there is a need for improved damping at the fundamental resonant frequency of single-ended planar-magnetic speakers to lower distortion.

Further, combination of thin-film diaphragms and conductive materials of the attached coil of prior planar-magnetic speakers has presented design challenges. Polyester diaphragms that have often been used in prior planar-magnetic transducers have exhibited poor thermal stability and poor dimensional stability at elevated temperature. This has heretofore been a practical limitation to increased sound pressure levels with single-ended planar-magnetic systems due to thermal instability limitations of the diaphragms; and, also, of de-bonding of adhesives used to attach conductive wires and/or strip regions to such diaphragms. Thermally-induced deformation problems have been further magnified by low efficiency due to relatively poor magnetic coupling in prior single-ended devices, requiring greater power input to the conductive coil, more localized heating, and therefore requiring greater thermal dissipation for a given acoustic output level. Accordingly, there is a need for a diaphragm/conductive coil combination with greater thermal and dimensional stability to maintain proper tension.

In summary, heretofore neither double-ended or single-ended designs of planar-magnetic loudspeakers have reached a stage of development which enables them to be favorably competitive with speakers of the first two types discussed above (dynamic and electrostatic) having much less stringent manufacturing requirements, smaller size, higher efficiencies, and lower costs. This lack of market success has continued over a period of more than 40 years since planar-magnetic acoustic transducers were first disclosed. As mentioned, even the appearance, over the last decade, of high energy magnets such as those comprising neodymium have heretofore not been exploited to offer needed improvements, particularly within single-ended speaker structures.

SUMMARY OF THE INVENTION

The invention provides A single-ended planar-magnetic transducer comprising a vibratable diaphragm including an active region and a magnetic structure including at least three magnet rows adjacent and substantially parallel to each other. The magnets have an energy of greater than 25 mega Gauss Oersteds. A mounting support structure coupled to the primary magnetic structure and the diaphragm is configured to hold the diaphragm in long term stable tension and provide a gap between the magnetic structure and the diaphragm. A conductor is carried by the diaphragm in the active area, and is configured to cooperate with the magnetic structure in vibrating the diaphragm to convert an input electrical signal into a corresponding acoustic output. The mounting support structure, the magnetic structure, the conductor, and the diaphragm are cooperatively composed and configured to operate as a single-ended planar-magnetic transducer; and also, so that the mounting support structure stabilizes the diaphragm in a tension which remains stable over extended periods of use, despite occurrence of dynamic conditions in response to high energy forces driving the diaphragm to provide the audio output, and despite the high-energy magnetic forces interacting between said at least three magnets to deform the mounting support structure.

In another aspect, the invention provides a planar-magnetic transducer comprising at least one thin-film vibratable diaphragm with a first surface side and a second surface side, including an active region, said active region including a conductive surface area for converting an electrical input signal to a corresponding acoustic output; and, a magnetic structure including at least three elongated magnets placed adjacent, and substantially parallel, to each other with said magnets being of high energy, each having an energy product of greater than 25 mega Gauss Oersteds which results in strong interaction between adjacent magnets. The transducer further comprises a mounting support structure coupled to the magnetic structure and the diaphragm, to capture the diaphragm, and hold it in a predetermined state of tension. The diaphragm is also spaced at a distance from the magnetic structure adjacent one of the surface sides of the diaphragm. The conductive surface area includes one or more elongate conductive paths running substantially parallel with said magnets. The mounting support structure, and the at least three magnets of the magnetic structure, and the diaphragm, have coordinated compositions and are cooperatively configured and positioned in predetermined spatial relationships, wherein: (i) the mounting support structure stabilizes the diaphragm in a static configuration at a predetermined proper or operable tension which remains stable over and between extended periods of use, despite occurrence of dynamic conditions in response to extreme high energy forces driving the diaphragm to audio output, and (II) the high energy magnetic forces interacting between the said at least three magnets do not interfere with the tension of the diaphragm; and said planar-magnetic transducer being operable as a single-ended transducer.

In a more detailed aspect, the high-energy magnets can comprise neodymium. The high energy magnets can have an energy of at least 34 MGO. In a further more detailed aspect the diaphragm can comprise PEN, and further can a have a damping material disposed around a periphery of the active area. The conductor can be incorporated in the diaphragm and also can be coupled to the diaphragm by an adhesive.

In a further more detailed aspect the transducer can comprise an inter-magnet brace which can stabilize the magnets of the magnet structure, and can also stabilize the mounting supporting structure, and can extend beyond the magnetic structure to abut and brace the support structure. The inter-magnet brace can comprises a conductive material, and can comprise a conductive material that is non-magnetic, e.g. a non-ferrous metal, and it can be formed of copper.

In another more detailed aspect an inter-magnet spacing between two adjacent magnets can be greater than one half a width of one of the two adjacent magnets. The spacing can be greater than the width of either of the two adjacent magnets, or some value between half and full width of either of the magnets. The magnets can have a transverse or cross sectional shape wherein the width is at least as great as the height.

In a further more detailed aspect the energy of the magnets can be varied from a central portion or line of symmetry outward laterally in the magnetic structure. The gap between the face of the magnets and the diaphragm can be varied, so as to be greater in a central portion and decrease laterally outward from the center of the magnetic structure.

In another more detailed aspect, the diaphragm can be made smaller than 150 square inches, and can be made taller than it is wide and vice-versa. Transducers in accordance with the invention can be made having a low frequency range facilitating crossover to woofers, and can be configured to have a high frequency range enabling them to be configured as tweeters and as ultrasonic emitters enabling parametric sound reproduction.

Other features and advantages of the invention will be apparent with reference to the following detailed description, taken together with the appended drawings, both of which are given by way of example, and not by way of limitation.

DETAILED DESCRIPTION

Figure 1:
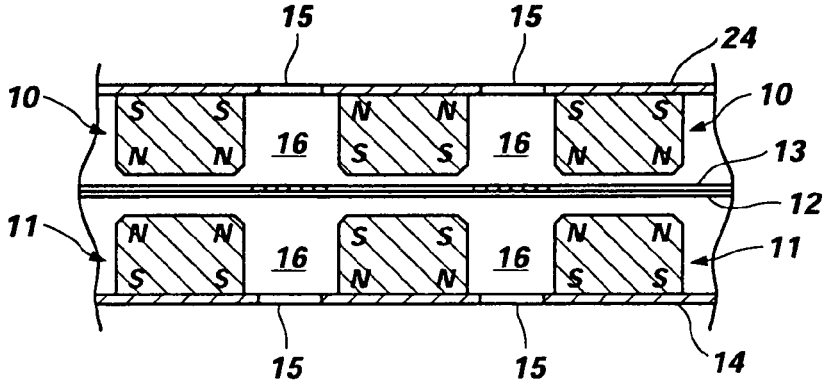
Fig. 1 (PRIOR ART)
FIG. 1 is a cross-sectional fragmentary view of an exemplary prior push-pull planar-magnetic transducer with a double-ended magnetic structure.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended.

Figure 4:
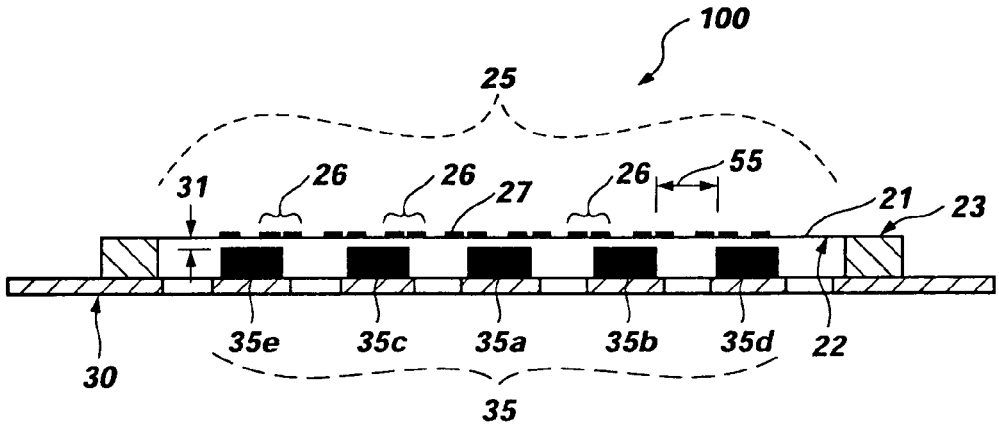
FIG. 4 is a cross-sectional view of an exemplary single-ended planar-magnetic transducer in accordance with principles of the invention.

With reference to FIG. 4, in one embodiment a single-ended, fringe-field planar-magnetic transducer 100, comprising at least one thin-film vibratable diaphragm 21 with a first side surface side 22 and a second surface side 23, further comprises an active region 25. The active region being defined by a portion of the diaphragm which substantially contributes to generation of an acoustic output, and therefore includes a portion of the diaphragm which does not, in most instances, extend to all the surface area of the diaphragm. It does include a portion of the diaphragm having coil wires or conductive strips attached. In the illustrated embodiment strips are attached and themselves define a conductive surface area 26 on the diaphragms which is covered by conductive strips 27 of the coil and which are configured for converting an input electrical signal into a corresponding acoustic output in cooperation with a magnetic structure 35 comprising a multiplicity of magnet strips, or a multiplicity of rows of discrete magnets. The portion of the diaphragm which is bonded to the support structure 30 as well as a portion of the diaphragm adjacent the portion which is bonded to the support structure do not substantially contribute to acoustic output, as they are constrained by the support structure, and can only vibrate at certain frequencies, for example those where resonance of the support structure is possible. Accordingly, these portions of the diaphragm contribute little, if any, to acoustic output in ordinary use, and may even work to distort the acoustic output at certain frequencies. For convenience we define such portions of the diaphragm to be outside the active area, and those portions which do constructively contribute to a desired acoustic output to be within the active area.

The mounting support structure 30 is coupled to the diaphragm 21 to capture the diaphragm at its outer periphery, hold it in a predetermined state of tension, and space it at a desired predetermined distance 31 from the magnetic structure 35 adjacent one of the surface sides, as shown in the figure, being a first surface side 22 of the film diaphragm 21. The proper tensioning levels for the diaphragm are determined by the desired fundamental resonant frequency for the device as a whole, and the diaphragm is tensioned until the diaphragm is set for that resonant frequency either upon assembly or set tighter to a slightly higher frequency to allow the diaphragm to settle into the desired frequency due to the diaphragm stretching slightly when put under tension and then reaching stasis at the desired resonant frequency.

The magnetic structure 35 typically comprises at least three rows of elongate magnets, with the embodiment shown in the figure having five rows of elongated magnets 35*a* through 35*e* which are placed adjacent and substantially parallel to each other. In this embodiment the magnets are of relatively high energy with each having an energy density of greater than 25 mega-Gauss-Oersteds (MGO). One possible material composition of the high-energy magnets includes neodymium, with the energy density of the neodymium being at least 34 MGO.

The conductive surface area 26 includes elongate conductive paths 27 running substantially in a parallel configuration with said elongated magnet rows. For convenience reference will be made to elongated magnets and elongated magnet rows interchangeably, but it will be understood that these can be formed of elongated unitary magnets, or a series of discrete magnets arranged in an elongated row. The alignment of the conductive paths and magnets needs to be sufficiently collinear or parallel to enable efficient interaction of the magnetic field forces developed by the magnets and magnetic field forces developed by current flowing in the conductive pathways thereby generating the required forces to drive the diaphragm to produce the desired audio output.

The mounting support structure 30, the diaphragm 21 and the five rows of elongated magnets of the magnetic structure 35 are cooperatively configured and positioned in a spaced-apart relationship, wherein (i) the mounting support structure 30 stabilizes the magnetic structure and (ii) the high energy magnetic forces interact between the rows of magnets so as to not interfere with the predetermined tension of the diaphragm 21. This is done in a way contrary to the accepted wisdom of providing a closer spacing of the magnets to provide a higher energy magnetic field. We have discovered that by using higher energy magnets, and increasing the spacing between them that many of the difficulties of prior planar-magnetic transducers discussed above can be mitigated. By striking a balance between magnet spacing and magnet strength and conductor placement (some portions of the diaphragm being not used to carry conductors), better efficiency is obtained in terms of audio output per cost of manufacture in a single-ended device. It will be appreciated that the configuration (composition/energy density, shape, and size) of the magnets must be considered to define the proper spacing required between adjacent magnets; or, to approach the problem another way, if a certain spacing is desired then the shape, size and strength of the magnets should be chosen with balanced, coordinated values to match, as will be discussed hereafter. In either case, the placement of the conductors on the diaphragm is done so as to maximize the magnetic coupling of the diaphragm coil and the magnetic structure.

This magnet structure configuration should also be considered in determining the configuration of the mounting structure, to ensure that there is sufficient strength and resilience to resist and counter the repulsive or attractive forces of the magnets, based upon the selected spacing of the magnets. Finally, the diaphragm configuration with its attached conductive coil elements should have the required properties of dimensional stability, as mentioned above, to complete the stable combination forming the physical structure of the transducer. These components are therefore cooperatively configured and positioned at a predetermined spaced-apart relationship which is selected to define the desired more efficient audio output per manufacturing cost characteristic of the transducer. By implementing correlated materials and dimensional construction, the transducer is able to maintain a long-term dimensional stability necessary to provide a competitive product with dynamic and electrostatic speaker systems, while operating as a single-ended transducer.

It has been found by the inventors that in single-ended planar-magnetic speaker systems, the diaphragm tension is a very important parameter. The tension should be set, and maintained, at a selected value for both reasonable performance and long-term reliability of that reasonable performance. Very small amounts of change (change equating to error in this context) over the lifetime of the device can significantly change performance, even to the point of making the device unusable. This has been a very difficult challenge to overcome, both in terms of initially obtaining the proper amount of tension evenly over the diaphragm surface (see, for example, U.S. Pat. No. 4,803,733) and, maintaining it over a period of years. Concerning the latter problem, with strong attraction between magnets in prior magnetic structures there is a tendency over time to deform the supporting structure so as to lessen diaphragm tension in the direction of attraction of the magnets. Tension calibration problems can arise due to interaction of magnetic forces attracting adjacent rows of magnets together and also by opposing magnets of like polarity repulsing each other, in either case over time changing the shape of the mounting structures such that tension is altered.

This long-term tension change problem has been further exacerbated by dimensional stability limitations of prior thin-film diaphragms. Such instability has been found to become significantly worse when attempting to utilize very high-energy magnets with strengths on the order of 5 to 40 times greater than those previously employed in prior single-ended planar-magnetic transducer configurations. Employing high-energy magnets in prior art structures with closer spacing, one generally induces much higher field strengths available for use, but also greater risk of deformation of the structure, for example by materials creep over time. It also can give rise to higher temperatures in the conductors. One can encounter long-term, if not immediate, disturbance of the critical tensioning calibration of the thin-film planar diaphragm due to deformation of the supporting structure giving rise to generalized slackening of the diaphragm, and also it is possible to have localized deformation outside the elastic range adjacent the conductors due to such conductor heating, which can also lower diaphragm tension overall, or give rise to undesirable audio artifacts.

The following considerations should be taken into account, and a balance found in single-ended transducer design in accordance with the invention: (i) magnetic field interaction between the fields generated by the diaphragm coils and the fields generated by the magnetic structure 35, which depends on magnet size, strength and the magnet spacings 55; (ii) configuration(s) and material(s) of the mounting support structure 30; and, (iii) dimensional stability of diaphragm 21 when used in a transducer incorporating the very high energy neodymium magnets of greater than 25 to 34 MGO (to values beyond 50 MGO), can be balanced to achieve a high performance speaker which is capable of sustaining long-term stability. Without these balanced relationships, the configuration of single-ended devices would, in the short term, and even more certainly in the long-term, interfere with the predetermined tension of the diaphragm.

In other words, these balanced relationships are achieved by selecting the strength and spatial relationships so as to increase localized field strengths, and at the same time, not greatly increase a net average field strength for the device as a whole. The undriven portions of the diaphragm then ride with driven portions, spaced farther apart, to obtain a greater net diaphragm displacement per signal strength in for the same cost of manufacture, than can be obtained by only increasing the net field strength. It will be apparent that what is accomplished is an economic efficiency increase, i.e. more usable audio output for the same cost of manufacture, without compromising long-term stability by a large increase in forces between magnets being transferred to the support structure.

The difficulty of the ongoing problem of stabilizing this important diaphragm tension parameter, along with related parameters of planar-magnetic devices with closer spacing of low-energy magnets appears to have discouraged effective application of the greater energy neodymium magnets to single-ended planar-magnetic transducers, even though this type of magnet has been available for over 10 years. As mentioned, this is perhaps due at least in part to a perception of required extreme close spacing of the respective magnets, developing an unworkable interaction of forces between these magnets. The inventors have surprisingly discovered that adopting a contrary approach direction of expansion of the spacing gaps between magnets, along with correlating the other parameters referenced above, enables effective utilization of the high energy magnetic fields within a stable configuration.

FIG. 4 shows an embodiment having five elongated rows of magnets. This basic transducer architecture of the embodiment could be operated with one or two rows of magnets, but it has been found that it achieves higher performance with at least three rows of magnets 35*a*, 35*b*, and 35*c*. It is found that by using odd numbers of rows of magnets the conductive areas or regions 26 can be formed to operate more efficiently. Therefore, three, five, and seven or more odd numbers of rows are used. This is at least in part due to the fact that in a configuration where polarity of the magnets is oriented perpendicular to the diaphragm coils, and the polarity is reversed between adjacent magnets, that a ferrous metal can be used for the support structure giving rise to a flux return path through the mounting structure, increasing efficiency. Furthermore by reversing polarity and using an odd number of magnets a coil configuration of conductive elements which does not cross over itself is enabled and permits both terminal ends to be positioned in close proximity, thus simplifying manufacture of the coil and manufacture of the speaker.

The present invention can also be viewed as a method for maintaining a set of parameters within a range of acceptable values for operation of a single-ended planar-magnetic transducer which utilizes a thin-film diaphragm 21 with a first surface side 22 and a second surface side 23 that includes a conductive region 26. The diaphragm is positioned and spaced from a magnetic structure 35 including high energy magnets, at least 35*a*, 35*b* and 35*c*, of greater than 25 MGO, preferably greater than 34 MGO, and in one embodiment are composed of neodymium. The parameters maintained by this method comprise (i) a proper spacing 55 between the magnets 35*a* through 35*e*, (ii) a magnet to diaphragm spacing 31, and (iii) proper ongoing diaphragm 21 tension values.

The method includes the steps of:

a) cooperatively configuring a support structure 30 and positioning the high-energy magnets of the magnetic structure 35 in a spaced apart relationship wherein the support structure 30 is not stressed in anticipated use of the speaker to a point where it undergoes a permanent deformation, wherein the support structure stabilizes the magnetic structure 35 and concurrently resists high energy magnetic forces interacting between the high energy magnets so as not to permanently alter a selected diaphragm 20 tension; and b) attaching the diaphragm 21 to the support structure 30 with the diaphragm 21 being placed in the selected diaphragm tension.

An exemplary embodiment in accordance with FIG. 4 comprises:

Diaphragm:
- Material: Kaladex™ PEN or polyethylenenaphthalate film
- Dimension: 0.001" thick, 2.75" wide by 6.75" long
- Conductor adhesive: Cross linked polyurethane approximately 5 microns thick
- Conductor: a relatively soft aluminum alloy foil layer 17 microns thick configured to cooperate with the magnetic structure to actuate the diaphragm to produce an audio output from an electrical signal input
- Aluminum conductive pattern as per FIG. 20
  - Resistance of conductive path=3.6 ohms
- CP Moyen polyvinylethelene damping compound applied (Per FIG. 17*a, b*)
- Four turns per gap
- Conductor width=0.060"
- Space between conductors in each pair=0.020"

Mounting Support Structure: 16 Gauge Cold Rolled Steel
- Dimensions: 3" by 8"
- 0.060 felt damping on backside of magnet structure
- Mounting structure to film adhesive—80 cps cyanoacrylate
- Magnet to diaphragm gap (31)=0.028"
- Magnet to magnet spacing gap (55)=0.188"

Figure 5:
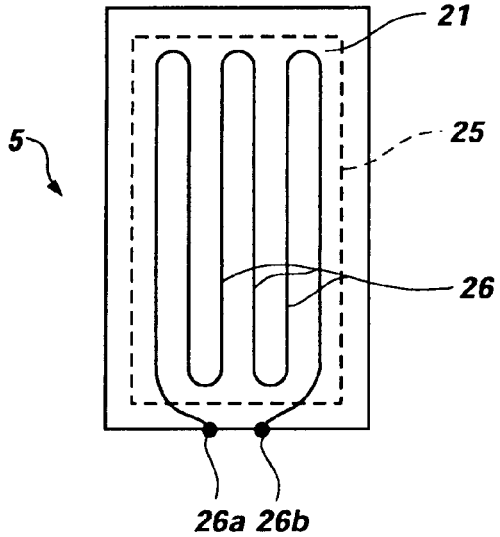
FIG. 5 is a front view of an exemplary planar-magnetic transducer in accordance with principles of the invention, a coil pattern is simplified and structure other than that associated with the diaphragm has not been included for clarity of presentation.

Magnets:
- Adhesive attachment: catalyzed anaerobic acrylic
- Five rows of three magnets each 0.188" wide, 0.090 thick, 2" long, each row being 6" long
  - Nickel coated Neodymium Iron Boron 40 mega Gauss Oersteds Performance:
- Resonant frequency: 200–230 Hz (adjustable by diaphragm tension)
- High frequency bandwidth: −3 dB @>30 kHz
- Sensitivity: 2.83 volts>92 dB With reference to FIG. 5, which illustrates a diaphragm configuration in an embodiment similar to the embodiment shown in the previous figure, at least one thin-film vibratable diaphragm 21 includes an active region 25, as defined above, of less than 150 square inches. The active region includes a conductive portion 26 configured for cooperation with the magnetic structure (not shown) in converting the input electrical signal into a corresponding acoustic output. The conductive portion comprises a wire or trace comprising a conductive material, and is incorporated in or attached to the diaphragm so that the two integrally form the active region. The driving signal, typically output from a power amplifier, is input at terminals 26*a* and 26*b*. The output of the transducer has an upper audio bandwidth limit, usually extending up to the treble range. An upper limit of audio output bandwidth even greater than 20 kHz is obtained in some embodiments, some embodiments reaching 50 kHz or more. High frequency bandwidth is affected by the diaphragm size, diaphragm moving mass, and the inductance of the conductive portion of the diaphragm. One of the advantages of the invention is that the device diaphragm can be realized with smaller area, lower moving mass, and less inductance than prior art single ended devices, all of which can contribute to more extended high frequency response. Further, and surprisingly, for single-ended devices of this small size, the audio performance extends down to a lower audio frequency range sufficiently low enough, down to the 50 to 500 Hz range in many embodiments, to enable crossing over to a woofer, while also having the ability to perform at very high sound pressure levels across the bandwidth. This unexpected improvement in combining smaller size and compatibility for integrating with lower frequency devices enables conventional crossover network integration with standard low frequency sound reproduction equipment, which can greatly enhance the marketability of the planar-magnetic speaker in accordance with the invention. Based on the foregoing, and favorable cost of manufacturing, this opens new doors for effective competition with conventional dynamic speaker systems.

This unexpected compatibility of the present invention with low frequency woofers, even when the invented device is much smaller than prior art single ended planar magnetic loudspeakers, extends to embodiments in which the active region 25 has a total surface area of less than 100 square inches, even to less than 80, or even much less than 60 square inches in selected embodiments. Despite this small surface area, these devices can still perform down to a woofer crossover frequency, and typically have an operating fundamental resonant frequency of less than 400 Hz with the ability to operate with a low frequency limit of 50 to 500 Hz or less. In transducers in accordance with the invention the fundamental operating resonant frequency is approximately the low-end limit of useful operating frequency range of the device. Even transducers having such an operating resonant frequency of less than 300 Hz can be accomplished in surprisingly small sizes while still achieving unusually high efficiencies and sound pressure levels compared to prior art single-ended planar-magnetic devices. In some embodiments, the inventive devices that have active diaphragm widths of less than 2.5 inches but with lengths of 2 to 48 inches or more can operate effectively with fundamental resonance frequencies in the range of 150 to 500 Hz. The high energy, high stability magnetic structures can provide higher efficiencies than the prior art even with the small diaphragm areas. When the diaphragm form factor is altered to be on the order of 8 inches wide and 8 to 48 inches (or more) long the resonant frequency and lowest frequency of operation can be reduced to well below 100 Hz while still remaining much smaller in size than a prior art single ended planar magnetic loudspeaker with the ability to reproduce as low a frequency. Further, the invention would not only be smaller but can also have greater efficiency. Devices of the prior art, when built to these sizes are limited to efficiencies that are too low and therefore have limited sound pressure level capability.

Even smaller devices, having active diaphragm areas totaling less than 20 square inches can still operate at a resonant frequency of substantially less than 400 Hz and maintain very good efficiency, generating very high audio outputs compared to prior single-ended planar-magnetic transducers of the same size or larger. This small size device can even be optimized to have a resonant frequency well below 300 Hz and maintain very good performance from the resonant frequency on higher frequencies up to and beyond audibility without requiring a separate tweeter.

Even more surprisingly, wide range transducer embodiments of the invention can be made smaller than most prior art single-ended, high frequency only (generally greater than 1500 Hz), planar-magnetic tweeters (25*b*, FIG. 6) having sizes of greater than 50 $in^2$. These invented devices of much smaller area can be operated effectively as an extended-range tweeter while at the same time have the ability to work effectively down to a low frequency range such as 50 to 500 Hz. It has been found that a planar-magnetic transducer in accordance with some embodiments of the invention can be made having an active diaphragm region with a total surface area of less than 9 square inches which will out-produce the prior art structure, while still having an operating resonant frequency as low as 500 Hz or less due to much greater efficiency per unit area and more effective diaphragm control at the fundamental resonant frequency.

Figure 6:
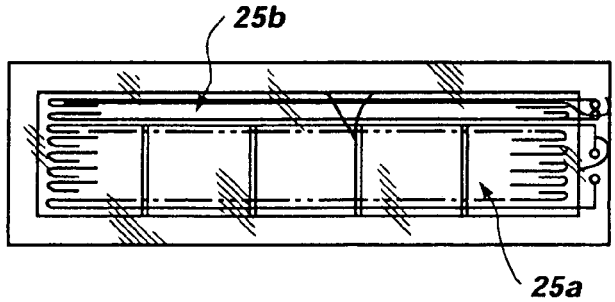
Fig. 6 (PRIOR ART)
FIG. 6 is a front view of an exemplary prior art transducer.
Figure 7:
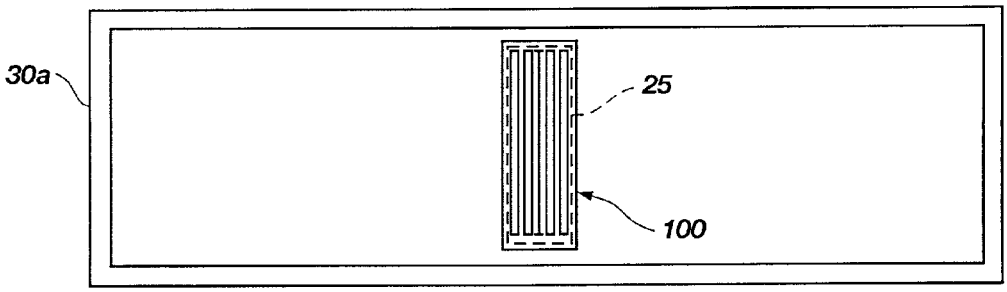
FIG. 7 is a front view of an embodiment of the invention shown interposed with a structure size typical of a prior art device having some of the same characteristics.
Figure 8:
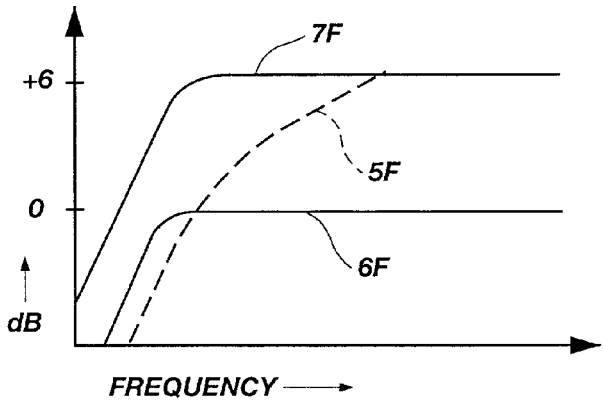
FIG. 8 is a dB vs. frequency plot providing a graphical comparison of frequency response and efficiency of a device in accordance with the invention and a prior art device.

An exemplary comparison of an embodiment of the invention compared to a prior art single-ended planar-magnetic loudspeakers may be further instructive of the advantages made possible. Take a hypothetical case of a transducer in accordance with FIGS. 4 and 5 and sizing it so as to have a 2.75" by 7.5" active diaphragm area 25 (less than 20 square inches). Contrast this with the smallest prior art single-ended devices known to applicants, a device with a diaphragm and frame having dimensions of about 34" by 10"; and, configured substantially as shown in FIG. 6 (see U.S. Pat. No. 3,919,499 to Winery). When compared to transducers in accordance with the invention, such a prior device required a separate midrange portion 25*a* and tweeter portion 25*b* to extend the system into the treble range effectively (adding to manufacturing cost). The efficiency of the speakers in the FIG. 4 embodiment of the invention is at least 6 dB more than the prior art device, and only needs an active diaphragm area about 1/10th the size. This is further illustrated by the graph of FIG. 8, wherein a frequency amplitude curve 5*f* represents the output of an unbaffled transducer in accordance with FIGS. 4 and 5, the curve 6*f* that of a baffled prior art device (FIG. 6) of more than 10 times the area, and 7*f* represents the frequency amplitude cure of a baffled transducer 100 of in accordance with FIGS. 4 and 5 (and as shown in FIG. 7). As illustrated by FIG. 7, such a device, with less than 1/10th the active diaphragm area 25 (shown for comparison inside a frame 30*a* of the prior device) can be made this much smaller and still have substantially the same frequency response but six dB greater sensitivity. Embodiments of the invention can have even greater efficiency advantages.

The unique specification of range of size, frequency range, and magnet 35*a* to a diaphragm 21 magnetic air gap 31 of the exemplary embodiment shown in FIG. 4, can be further illustrated in the formulas expressed below, particularly for the invented transducers having total active diaphragm areas of less than 150 square inches. These formulae define structures that have been unrealizable in prior art single-ended planar magnetic devices.

The first being:

$$Fr<(2000/\text{square root of } A)$$

wherein (Fr) equals the fundamental operational resonant frequency of the transducer in Hertz and (A) equals the vibratable area of the transducer diaphragm in square inches. This formula defines the relationship of frequency to area of the speaker. This expression is independent of gap size and focuses more on frequency as a function of the size of the diaphragm.

A second formula is:

$$Fr<(1500/\text{square root of } A)/G$$

wherein (Fr) equals the fundamental resonant frequency of the transducer in Hertz and (A) equals the vibratable area of the transducer diaphragm in square inches and (G) equals the magnet to diaphragm gap measured in millimeter at the center of the transducer diaphragm. In this case, the size of the gap is factored into the limitation for displacement of the diaphragm, which affects efficiency and large signal displacement limits.

A third formula contemplates an even more impressive range of operation for a very small-area device:

$$Fr<(1000/\text{Square root of } A)/G$$

wherein (Fr) equals the fundamental resonant frequency of the transducer in Hertz and (A) equals the vibratable area of the transducer diaphragm in square inches and (G) equals the magnet to diaphragm gap measured in millimeters as the center of the transducer diaphragm.

A fourth formula expresses similar parameters to those above but with the area being replaced simply by the width or smallest dimension (w) of height or width:

$$Fr<(1000/W)$$

And a fifth formula further includes the magnetic air gap.

$$Fr<(800/W)/G$$

wherein (Fr) equals the fundamental resonant frequency of the transducer in Hertz and (W) equals the smaller (width) dimension of the vibratable area of the transducer diaphragm in inches and (G) equals the magnet to diaphragm gap measured in millimeters at the center of the transducer diaphragm.

These formulas can realize a unique practical single ended planar magnetic loudspeaker in embodiments, such as shown in FIG. 4, for which a structure has been applied that can simultaneously support magnets of greater than 25 MGO, preferably greater than 34 MGO while being spaced to maximize distribution of magnetic energy and maintain diaphragm tension stability. This can achieved through magnet to magnet spacing that is at least 75 to 150 thousandths of an inch or at least one half of the width of one of the magnets.

Figure 9:
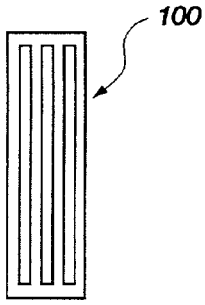
FIG. 9 is a front face view of an embodiment of the invention.
Figure 10B:
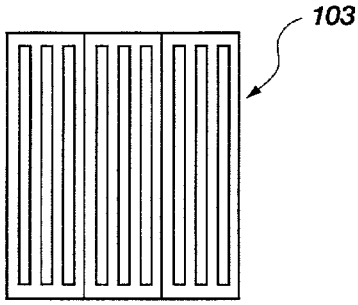
FIG. 10*b* is a front face view of a device incorporating multiple units of the embodiment of the invention of FIG. 9.
Figure 10A:
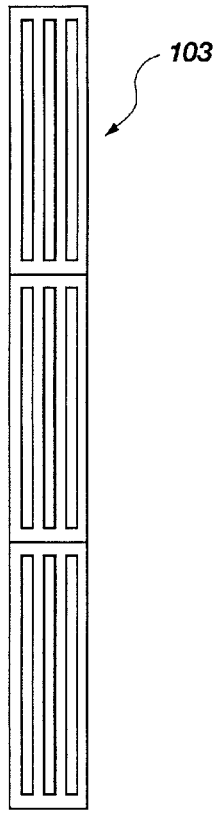
FIG. 10*a* is a front face view of a device incorporating multiple units of the embodiment of the invention of FIG. 9.

An embodiment that can be used for certain applications, such as home theatre, could be to combine a number of the planar-magnetic transducers 100 described above and as shown in FIG. 9 end on end to form, for instance, an elongated line source loudspeaker 103 shown in FIG. 10*a;* or side by side, as shown in FIG. 10*b* to make a wider loudspeaker. These transducers may be wired in series, parallel or a combination of the two.

Figure 11:
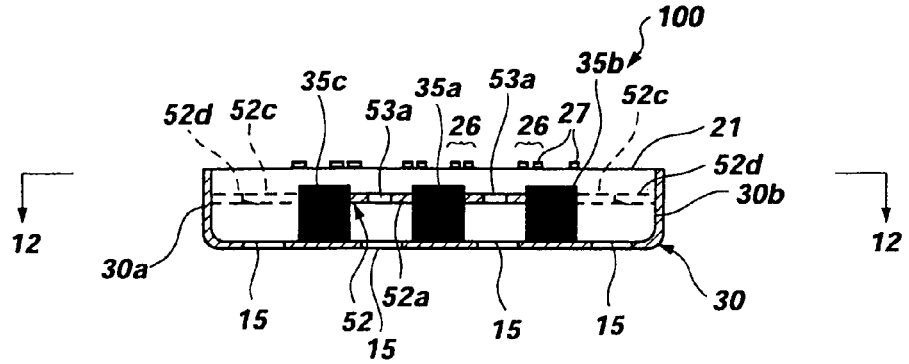
FIG. 11 is a cross-sectional view of an embodiment of the invention with inter-magnet braces other configurations of the braces being shown in outline and corresponding to the alternatives shown in FIG. 12.
Figure 12:
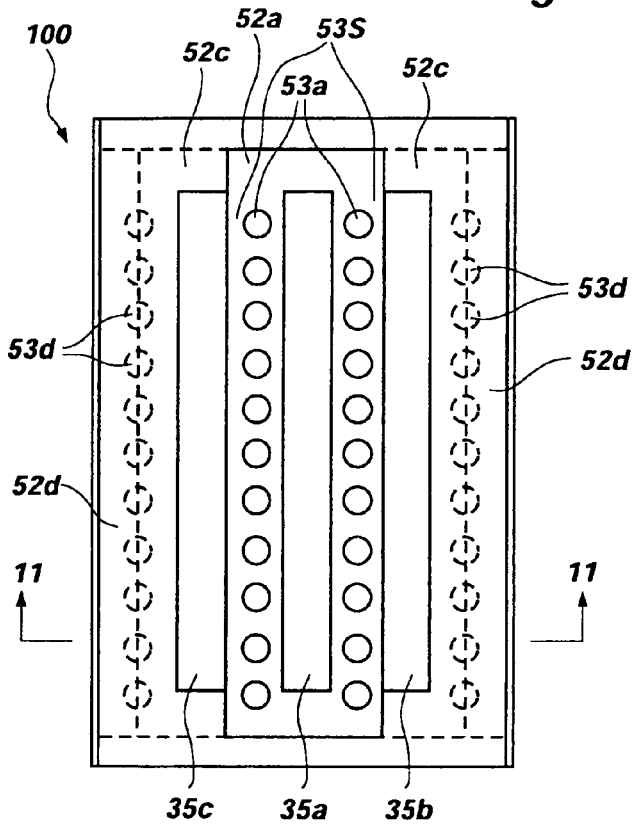
FIG. 12 is a front face view of the embodiment of FIG. 11 illustrating inter-magnet braces, alternate embodiments being shown in outline.

With reference to FIGS. 11 and 12, in another embodiment further structural elements facilitate obtaining the advantages of high-energy magnets to provide performance enhancements while avoiding the previously-discussed problems that can arise. Due to the extraordinary inter-magnet forces when using very high energy magnets 35*a*, 35*b*, and 35*c*, such as >35 MGO neodymium, which, as mentioned, further bracing structure 52 can be provided to keep the inter-magnet attraction and repulsion forces from distorting the main support structure 30 and therefore interfering with the tension calibration of the of the diaphragm 21.

At least one brace structure 52 is positioned in abutting configuration between at least two, and preferably all, of the adjacent high-energy magnets 35*a*, 35*b*, and 35*c*. This helps to mitigate the effect of magnetic attraction forces potentially reducing the predetermined distance between at least two of the high-energy magnets, so the high-energy magnetic forces do not deform the support structure 30 and thereby interfere with the preset tension of the diaphragm 21.

Figure 13:
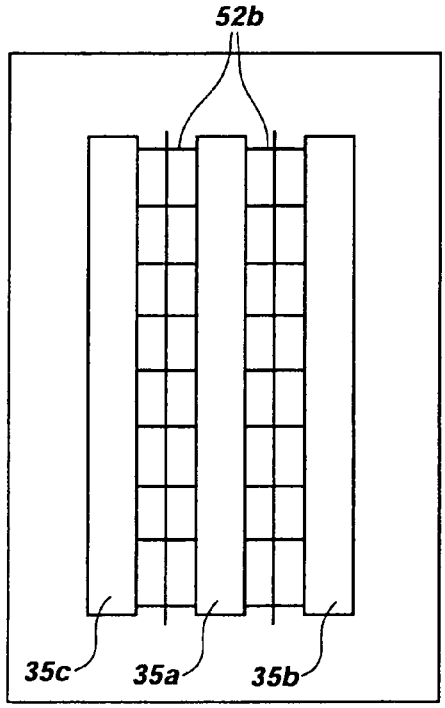
FIG. 13 is a front face view of another embodiment of the invention incorporating different inter-magnet braces comprising a latticework, which latticework can be independently attached to other structure at locations directly below that shown in the figure, and thus underneath and hidden by the latticework shown, and accordingly not visible in the figure.

Consider one embodiment having a brace structure 52*a*. In this case the structure is a plate abutting the magnets to hold them in place and resist their magnetic attraction. It can be seen that holes 53*a* through plate 52*a* can be provided to allow air and sound waves to pass through and the plate is at least partially acoustically transparent. In this connection, in another embodiment, as seen in FIG. 13 a bracing spacer structure 52*b* configured for maintaining positioning of high energy magnets 35*a*, 35*b*, and 35*c* can be a lattice structure that is configured to resist compressive forces while also being very open to realize a high degree of acoustic transparency. This type of structure could be used between any two magnets or between each adjacent pair of adjacent magnets when using two, three, four, five or more rows of magnets.

Returning to the embodiment shown in FIGS. 11 and 12, the spacer plate 52*a* could be extended around the outer periphery of the outer two magnets 35*b*, 35*c* (52*c*) to further rigidify the structure. Moreover, the plate can be further extended at an outer periphery 52*d* on either side, to extend to, and abut, side portions 30*a*, 30*b* of the substrate of the support structure 30. In this embodiment, further holes 53*d* are provided outside of the outer magnets 35*c*, 35*b*. This latter configuration provides additional rigidity, not only to the magnets, but also to the side portions 30*a*, 30*b* of the support structure, further helping to stabilize the U-shaped-sectioned support structure of this embodiment to tension the diaphragm 21 with minimal variation in tension.

These features may also be thought of as a way for maintaining diaphragm calibration for operation of a single-ended planar-magnetic transducer which utilizes a thin film diaphragm 21 with a first surface side 22 and a second surface side 23 and includes a conductive region 26. The conductive region is positioned and spaced from a magnetic structure 35 including high energy magnets, at least 35*a*, 35*b* and 35*c*, of greater than 25 MGO, preferably greater than 34 MGO, and composed of neodymium. The calibration in this method relates to i) proper spacing 55 (FIG. 4) between the magnets 35*a* through 35*e*, ii) magnet to diaphragm spacing 31 (FIG. 4), and iii) proper diaphragm 21 tension. This includes the steps of:

a) cooperatively configuring a mounting support structure 30 and a magnetic structure 35, positioning the high energy magnets of the magnetic structure 35 in a laterally spaced-apart relationship, and wherein the mounting support structure 30 stabilizes the magnetic structure 35 and resists high energy magnetic forces interacting between the high energy magnets, so as not to interfere with the tension of a diaphragm 21;

b) attaching the diaphragm to the support structure with the diaphragm placed in a selected diaphragm tension; and, c) placing an inter-magnet brace/spacer structure 52 in abutting relationship to and between the adjacent magnets.

It will be apparent that the foregoing steps are not in an order of execution, which can be varied. For example, a spacer might be attached to and/or around all the magnets near a top face of each, then the magnets can be attached to the support structure, then the diaphragm is tensioned and attached, with attention to registration between the conductive areas (the traces or wires) and the magnets of the magnetic structure.

It should be noted that while the conductive traces 26 of the coil are shown attached to the second surface side 23 of the diaphragm 21 opposite the magnetic structure 35, they could be located on the first surface side 22 closest to the magnets. Moreover, the conductors can also be incorporated within the diaphragm, for example by forming the diaphragm of a plurality of layers with the conductive traces sandwiched between, or otherwise incorporating conductive material in the coil pattern desired within the diaphragm itself. As an example of the latter, locally treating the diaphragm film so as to make it conductive, while leaving other portions of the diaphragm non-conductive, a coil pattern of conductive material can be formed. An adhesive and metal printing method can be used to deposit the conductive traces, as will be further discussed below.

In prior art single ended planar-magnetic loudspeakers, it has been a necessary practice to use many multiples of rows of magnets placed as close as possible to each other which can cause undue amounts of acoustic loading on the diaphragm as acoustic energy traverses the narrow channel between the magnets to the external environment. The narrower (or deeper) the channel between magnets the greater the resonant behavior at high frequencies which can cause a peak in the high frequency response followed by attenuation of the high frequency output, limiting high frequency extension.

Figure 2:
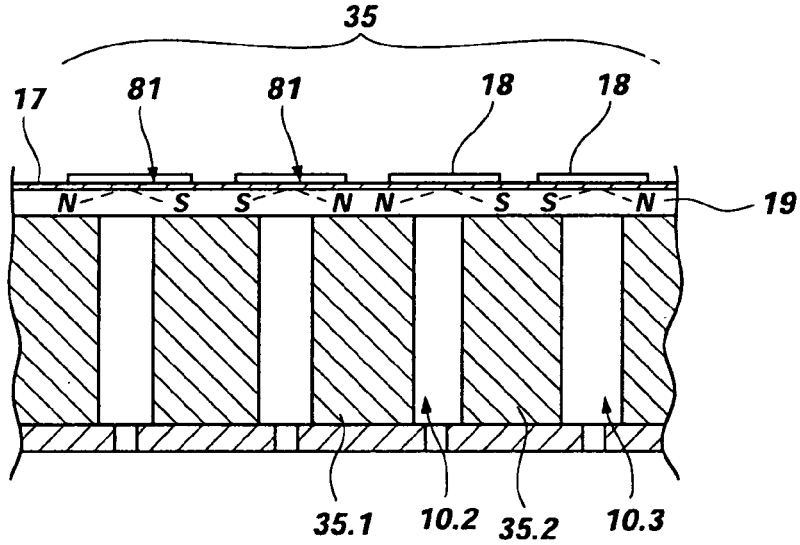
Fig. 2 (PRIOR ART)
FIG. 2 is a cross-sectional fragmentary view of an exemplary prior art single-ended planar-magnetic transducer.
Figure 3:
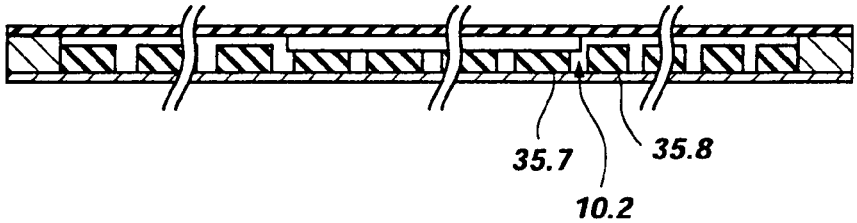
Fig. 3 (PRIOR ART)
FIG. 3 is a partially fragmentary cross-sectional view of another prior art single-ended planar-magnetic transducer.

With the novel use of very high energy magnets as in the instant invention, this standard practice of closest possible spacing with single ended loudspeakers can become extremely problematic, not only acoustically, but also mechanically. First, the inter-magnetic forces discussed previously become so significant that the stability of the mounting structures, particularly for long term reliability, can be at risk. Also, with the new levels of acoustic output available from the invented device, the acoustic loading through the prior art small openings (10.2 in FIG. 3), between the magnets 35.7 and 35.8 can become significant in terms of, not only, linear cavity resonance issues, but even to the point of causing non-linearities in system output. The same is true for the structure of FIG. 2 with narrow and deep slot 10.2 between magnets 35.1 and 35.2 wherein even greater loading comes from the attempt at deeper magnets for a single-ended device, causing acoustic tunneling and resonant cavities 10.2 and 10.3.

Figure 14:
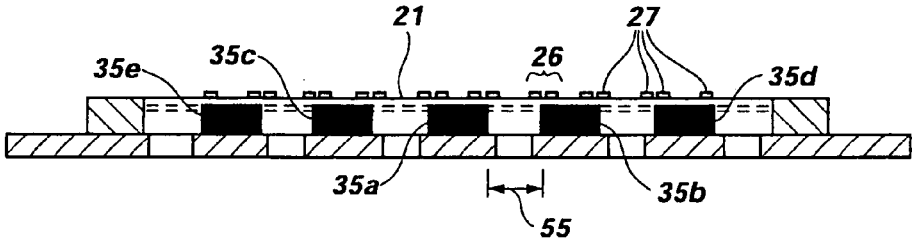
FIG. 14 is a cross-sectional view of an exemplary embodiment of the invention illustrating magnet spacing, a brace structure in one embodiment being shown in outline.

Turning now to FIG. 14, It has been found that using very high energy magnets 35*a*–*e* in a single-ended planar-magnetic transducer 100, and spacing the magnets at distances that would make the magnetic fields substantially ineffective in the prior systems, surprisingly, can improve the performance, value, and reliability of single-ended transducers over what has been done before, typically involving bringing the magnets closer together. In the novel approach, the distance 55 between at least two 35*a* and 35*b* of the adjacent high energy magnets 35*a* through 35*e* is at least seventy five thousandths of an inch. Further performance value and reliability can come from the spacing of at least two or more of the adjacent high energy magnets is at least ninety thousandths of an inch to 150 thousandths of an inch or more apart.

Another way to view the optimal spacing is wherein at least two of the adjacent high energy magnets 35*a* and 35*b* have common dimensions and the predetermined distance between them is at least one half the width of one of the magnets. Taking them to an even greater value in terms of magnet to diaphragm area ratio it is advantageous to expand the spacing to at least seventy or one hundred percent of the width of the at least one of the two adjacent magnets. This of course can be carried out with the spacing between all or a portion of the magnets, or to have variations of greater spacing between each pair. It has also been found that the depth of the magnets is optimized at values around the same as the width, and lower. In other words, the magnets are most economical when they are approximately square in cross section, or are less deep than would produce a square magnet. This is because the incremental strength increase of the magnet achieved by adding additional depth is not justified by the additional expense of the additional magnet material after about the point that the depth equals the height. It will be appreciated that more square square cross sections are generally desirable, but the magnets currently available become too breakable at some point and the lower limit on depth dimension is currently limited by materials concerns rather than an economic limit given by efficiency per unit cost. It should be noted that another constraint is getting enough coil turns in the gap for each magnetic circuit, and therefore a wider spacing and wider magnets (relatively speaking) allowing greater conductor area (coil returns) can be quite valuable in this regard.

The performance value can be enhanced through the above-stated approaches to magnet spacing partly because a greater area of the diaphragm can be driven with fewer magnets compared to the prior art. Put another way, a magnet volume to diaphragm area ratio can be very favorable to that of the prior art while generating even greater electroacoustic output efficiencies and more drive force across the diaphragm. This appears to be a superior approach to the distribution of magnetic energy in the device; and this concomitant new distribution of magnetic structure provides greater open area in the cavities between the magnets, which is acoustically advantageous, reduces inter-magnet forces and keeps them from disturbing the structure of the transducer and tension of the diaphragm, and provides better magnet volume to diaphragm area usage, for more economical, but at the same time, smaller, higher-performance devices.

A practical guideline on spacing, is to provide about ½ or less of the wavelength of the highest frequency sound wave to be produced by the transducer. In practical terms, about ¼ inch or less is a useful spacing distance to avoid noticeable distortion for transducers reproducing frequencies of 20 kHz or greater. The above-suggested dimensions of adjacent magnets and/or adjacent conductors can minimize effects of un-driven portions of the diaphragm moving differentially from those portions of the diaphragm controlled by the conductive coil interacting with the strong magnetic force.

Figure 20:
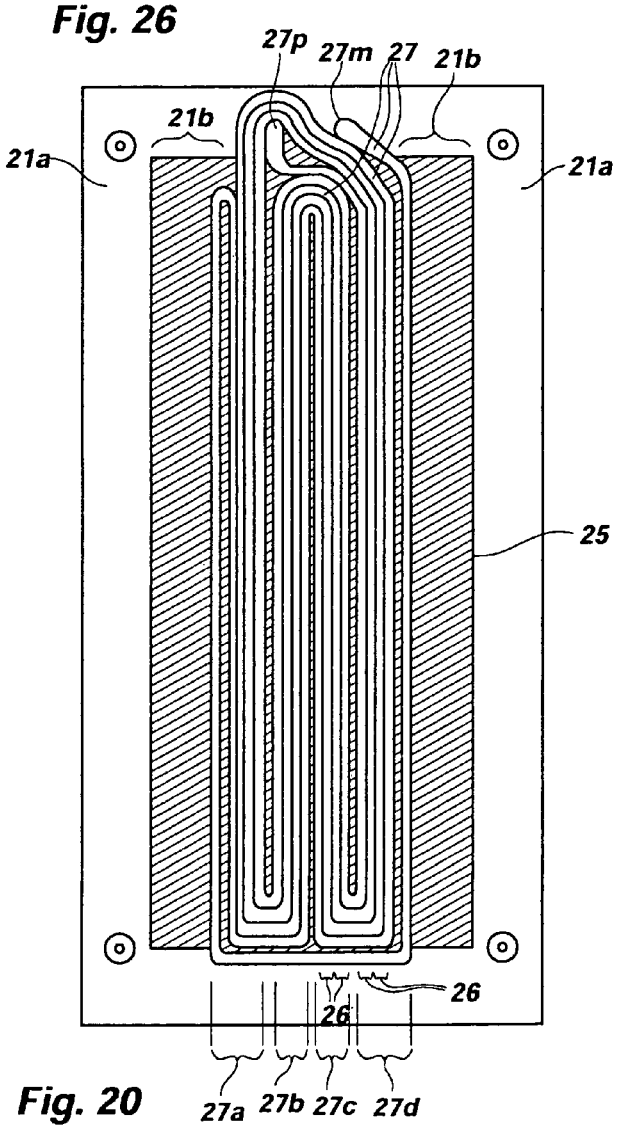
FIG. 20 is a front face view of a diaphragm useable with other embodiments shown in the figures.

In comparison with prior devices, the conductive areas 26 comprising individual traces/wires 27 are moved from between the magnets to adjacent the edges of the faces of the magnets 35*a–e*. In the illustrated embodiment two turns per magnet are employed, with the outer magnets 35*d* and *e* having one fewer turn on the outer edges. This has been found to be an advantageous arrangement from the standpoint of maximizing coil turns in higher intensity portions of the fields in this embodiment. FIG. 20 shows a possible pattern layout for conductive traces that could be employed with the embodiment shown in FIG. 14.

Figure 15:
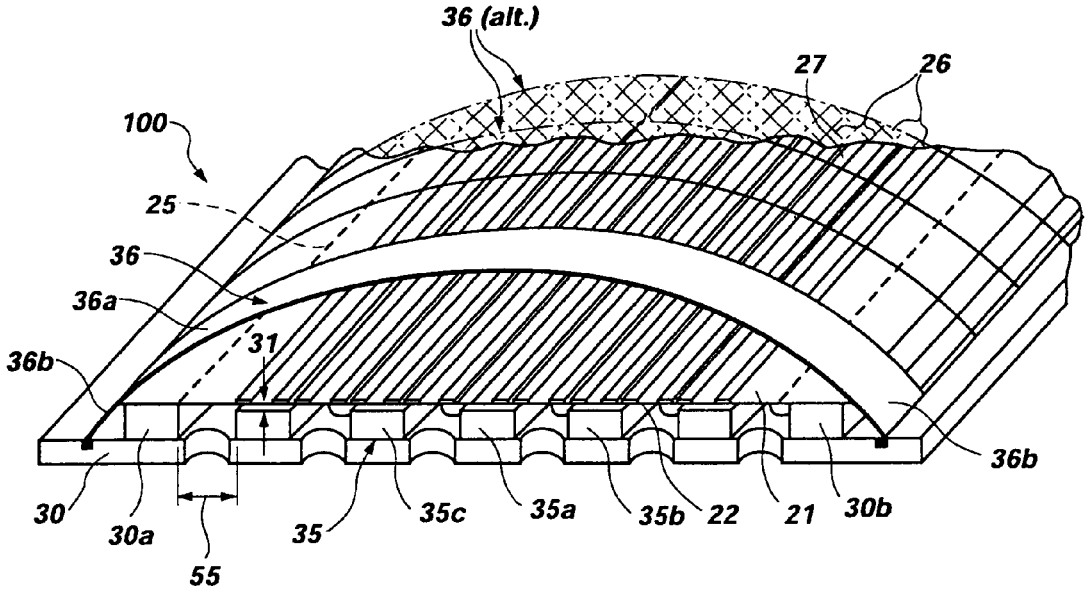
FIG. 15 is a perspective view, partially fragmentary, partially cross-sectional, of an embodiment of the invention with additional exemplary lateral support structures, and showing different alternative configurations for the lateral support structures at different portions of the device, i.e. as a band and as a latticework of wires or bars with cross-bracing, and a screen covering that can be included in one embodiment is shown in outline.

FIG. 15 shows an embodiment of the invention wherein a single-ended planar-magnetic transducer 100 has an additional structure 36 attached to the mounting support structure 30 that includes one or more lateral support structures 36*a* and 36*b* which project forward of the second surface side 23 of the diaphragm 21. As with the embodiments described above, the transducer includes a high-energy magnet array forming a magnetic structure 35 which is coupled to the mounting support structure 30. Diaphragm 21 mounting spacer portions 30*a* and 30*b* space the diaphragm the desired gap distance 31 from the magnetic structure. The diaphragm mounting spacer portion may either be separate, attached structures as shown, or can be integrated into mounting support structure 30. The lateral support structure is connected to and between the lateral extremes of the spacing portions of mounting support structure 30*a,* 30*b* that are outside of the lateral sides of the active region 25 of diaphragm 21. It can also attach to substrate portion of the structure 30, if any, which extends outward beyond the spacer portions. This serves to coordinate with, and support the transducer support structure to further brace it against the deforming effect of magnetic attraction forces acting to try to reduce the predetermined spacing distance 55 between the adjacent magnets 35*a,* 35*b,* and 35*c*, etc. and causing interference with the integrity of mounting support structure 30 and consistency in tensioning of the diaphragm 21.

Figure 16:
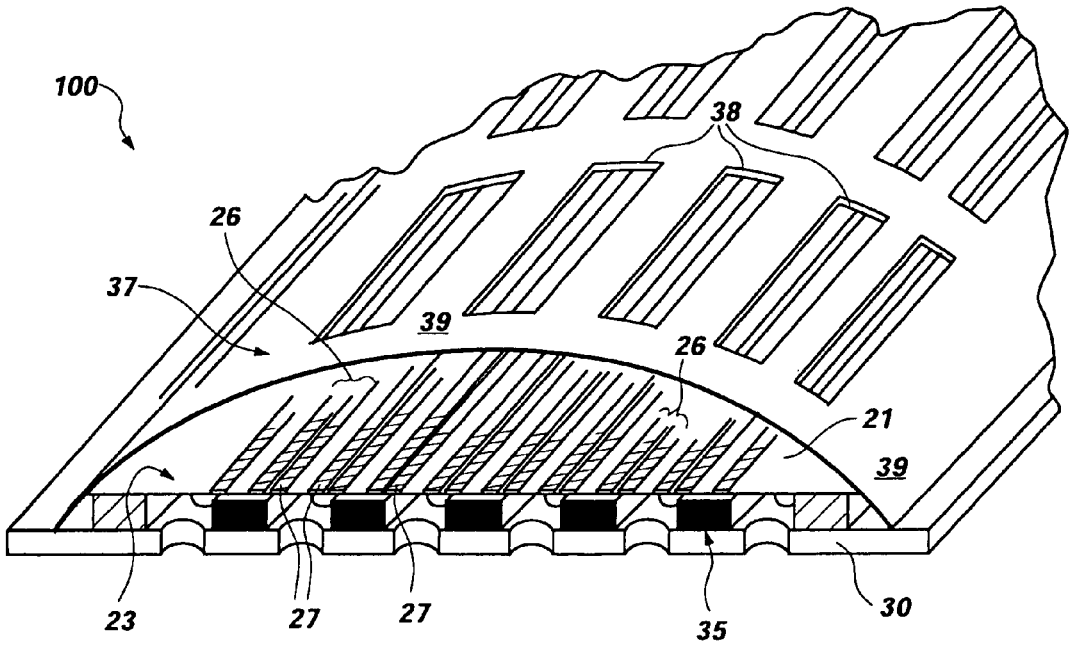
FIG. 16 is a perspective, partially fragmentary, partially cross-sectional, view of an embodiment of the invention, similar to that of FIG. 15, but with another exemplary lateral support structure.

FIG. 16 shows another, though similar, structural approach which is to attach a rigid covering structure 37 to the mounting support structure 30. The rigid covering structure is configured as a curved plate which has open areas 38 and closed areas 39. The cover would substantially cover the second surface side 23 of diaphragm 21. Again, the magnetic structure 35 is mounted to the mounting support structure 30 and the transducer is otherwise similar to that of FIG. 15 and those described before. The covering structure 37 would of course have acoustic transparency. Again, the curved structure is configured to resist bending of the mounting structure 30. It also protects the diaphragm from harm to some extent as it acts as a protective cage.

The rigid covering structure 37 can further be made from a ferrous composition which provides a degree of magnetic shielding. This shielding can be very important particularly when using the transducer 100, with high energy magnet structure 35, close to magnetically sensitive equipment, such as a video monitor. It has also been observed by the inventors that this use of a ferrous cover can draw the magnetic field more strongly into the plane of the diaphragm and provide approximately 1 dB of additional efficiency improvement in the transducer.

Returning to FIG. 15, the lateral support structure 36 of this embodiment can also be made to exhibit some shielding qualities, for example, by forming it as a lattice work of steel or other ferrous metal (36alt.) or as spaced apart bands of a ferrous material. In another embodiment, the latticework or bands can be covered by a wire mesh having shielding properties; and, in the latter case, the lateral support structure can be formed of a non-ferrous material.

These structures and compositions, which have not been utilized as such in prior art single ended planar-magnetic transducers, can be particularly significant in allowing the effective use of high energy neodymium magnets while avoiding the significant problems mentioned that can arise from their application in devices of this type.

Figure 17A:
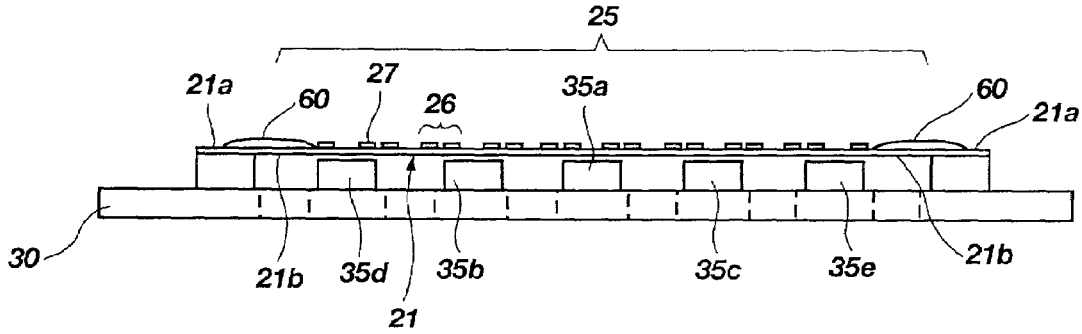
FIG. 17*a* is a schematic cross-sectional view of an embodiment of the invention with damping around a periphery of the diaphragm.

Referring now to FIGS. 17*a,b*, other issues related to the diaphragm 21 more specifically will be discussed. Along with the very critical parameter of diaphragm tension, another diaphragm 21 issue, related to tension and drive force relates to the behavior of an undriven portion around their periphery, between the strongly driven conductive region 26 and the termination point 21*a*. This undriven and/or termination area 21*b* can be the source of distortion and frequency response audio anomalies, particularly exacerbated by the increased drive levels associated with introducing high energy neodymium magnets to a single ended planar-magnetic transducer. It can be even more particularly applicable to one operating down to a woofer range. It is advantageous in mitigating these anomalies to damp the diaphragm by applying a viscous or mechanical damping material 60 along at least a portion of the periphery 21*a* and 21*b* of the vibratable diaphragm 21. It can be preferable to apply this material outside of the most central portion 21*c* where the conductive regions 26 drive the diaphragm. It has been found that it works effectively at damping out the anomalies while not causing an appreciable negative impact due to its additional mass, when placed outside of the portion of the diaphragm having conductive areas 26 and/or outside of the outermost row of magnets 35*d* and 35*e*, on each lateral side of the magnetic structure 35. One embodiment includes a thin viscous damping material 60 which comprises a solvent-based polyurethane compound applied to the diaphragm 21 and the diaphragm can be made of polyethylenenaphthalate (PEN) film. Other viscous damping materials that have the mechanical property of high internal damping such as polyester (Mylar) would also be well suited, such as an adhesive tape having a viscous adhesive of adequate amount for damping could be used. Although PEN is one preferred diaphragm material, other diaphragm materials could be utilized, such as polyester (Mylar™) or Kapton™.

While the diaphragm 21 mass increase impact of this damping approach does not seem to unduly affect efficiency, the extra mass can contribute to reducing the resonant frequency of a smaller planar-magnetic device, allowing both more extended response for a small size and allowing greater tensions for a given resonant frequency, which further reduces the above-mentioned audio anomalies. It also allows the wider distribution of magnets and greater undriven areas for greater output and larger effective diaphragm area without the prior art requirement for closely spaced, densely accumulated magnets over the surface of the diaphragm.

One can rather easily empirically determine an optimal amount of damping material for a given speaker-damping material combination by placing the damping material first just adjacent the outer termination points of the diaphragm 21*a* and after a trial in each case working inward towards the center of the diaphragm 21 to the point where the benefits reach diminishing returns and start to unduly impact efficiency.

Figure 17B:
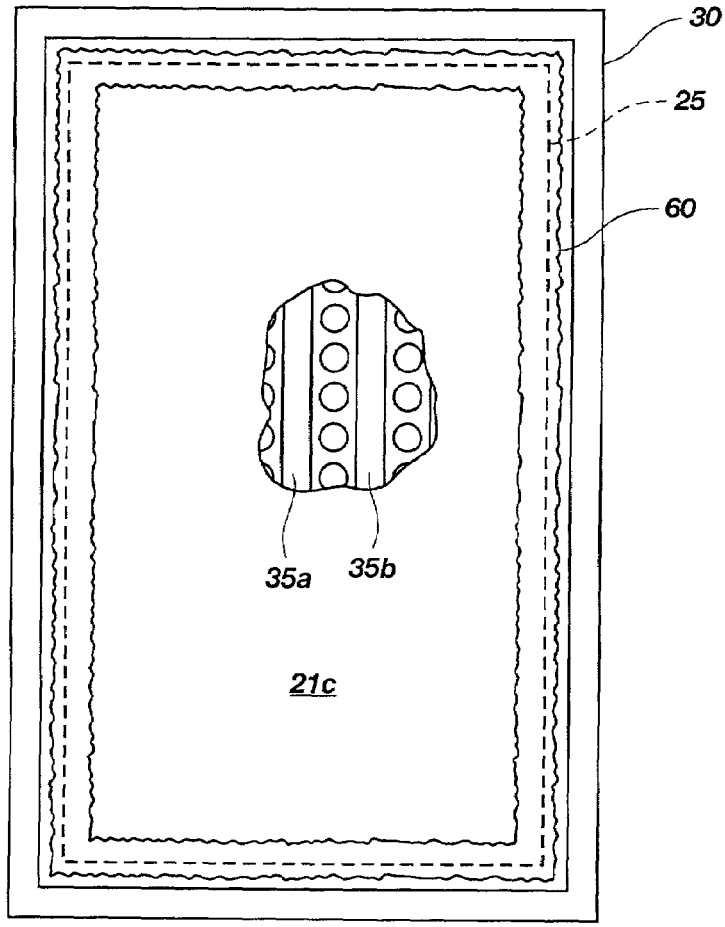
FIG. 17*b* is a front face, partially fragmentary, view of the device of FIG. 17*a;*

Returning to discussion of the diaphragm itself, with reference to FIG. 20 a diaphragm 21 with a patterned coil including conductive regions 26 made up of individual elongated conductive runs 27 is disposed on the film surface. Groups of 4 conductive runs, 27*a*–27*d*, in another embodiment could also be further optimized by having the left and right pairs, in each group of four, be separated by about half the distance that each group of four is spaced from each other. Each group of four runs is associated with, and centered over, a pair of adjacent magnets of different polarity relationship. The input ends of 27*p* and 27*m*, of the conductive regions 26, are adapted to be electrically connected to an audio signal source to receive incoming audio signals. A terminal area 21*a* is a general area of attachment and area 21*b* is the outer portion of the active area 25, not directly driven by the conductive regions and in some embodiments, preferably damped by a viscous damping medium as discussed previously and shown in FIGS. 17*a* and 17*b*.

The coil comprises aluminum conductive regions 26 which are attached to the diaphragm 21, comprising PEN film, by a cross-linking polymer adhesive. Other conductor materials can be substituted, as is the case with the adhesive used, and the diaphragm film, but the combination given has been found to work well and serves as an example combination.

Figure 18:
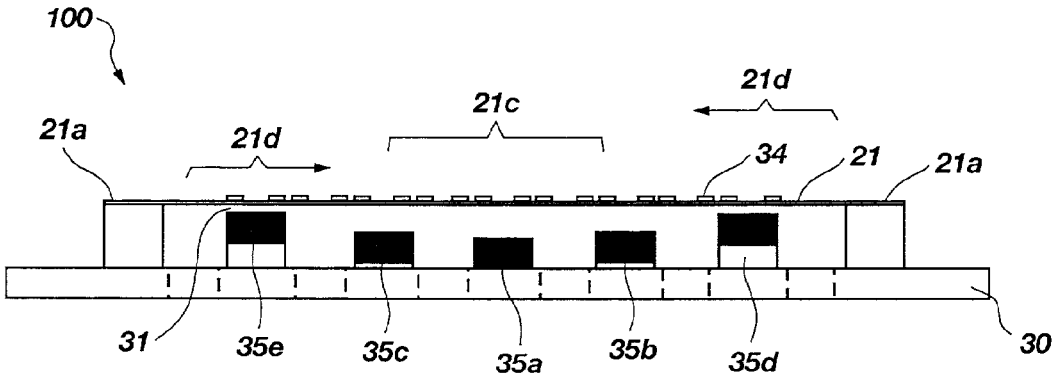
FIG. 18 is a schematic cross-sectional view of an embodiment of the invention with reducing magnet gaps for magnets with distance away from the central magnet or centerline of symmetry.

Turning now to FIG. 18, a further advantage that can be gained in a single-ended planar-magnetic transducer where high energy magnets are used is illustrated. A variable gap 31 between the magnet 35 faces and the diaphragm 21 allows more diaphragm excursion. The diaphragm has a central region 21*c* including the diaphragm region adjacent a central magnet 35*a* and lateral, that is to say, laterally more remote regions 21*d* that are a distance away from said central region 21*c*. The magnetic structure 35 has adjacent and lateral magnets 35*b* through 35*e* that are adjacent and more distance away from said central magnet 35*a*. The gap 31 between the diaphragm and the magnets of the magnetic structure 35 is greater at the central region 21*c* of the diaphragm which is positioned over at least one central magnet 35*a*, than at the remote diaphragm regions 21*d* which are positioned over one or more lateral, or more remote, magnets 35*b* and 35*c* and/or 35*d* and 35*e*.

This can take advantage of the fact that during its active state the vibratable diaphragm 21 exhibits more displacement in the central region 21*c* than at all regions 21*d* away from the central region particularly at high outputs when reproducing lower frequencies which demand the greatest diaphragm movements. With this in mind, it has been found that one can construct more effective magnetic coupling towards the outer portions of the transducer without reaching diaphragm excursion limits. This assists in obtaining the larger overall excursion at the central portion.

Figure 19:
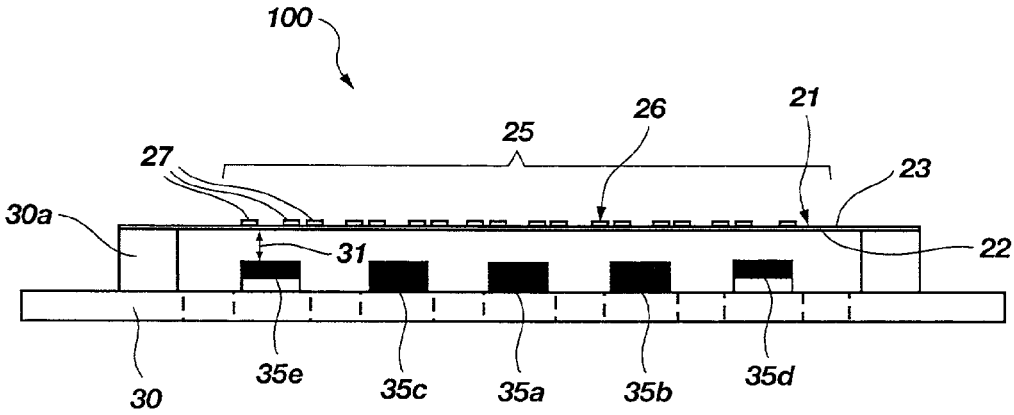
FIG. 19 is a schematic cross-sectional view of an embodiment of the invention with reducing magnet strengths for magnets with distance away from a central magnet or center of symmetry.

FIG. 19 illustrates another embodiment shows an additional and compatible approach wherein the planar-magnetic transducer 100 comprises at least one thin film vibratable diaphragm 21 with a first surface side 22 and a second surface side 23, including a predetermined active region 25. A magnetic structure 35 including at least three central deeper and comparatively more powerful magnets 35*a*, 35*b*, 35*c* and additional magnets 35*d* and 35*e* of less energy is provided.

As with the other embodiments the magnets can be of alternating polarity. When the support structure is of a ferrous metal it provides a flux return path between the magnets and more energy of the magnetic structure 35 is made available than would be the case if all were of the same polarity.

The magnetic structure 35 has five adjacent rows of magnets 35*a*–*e*, with at least an outer two rows of the magnets 35*d* and 35*e* being of lower total energy, by reason of being smaller, particularly, by being less deep, or by reason of being of less energy density. The outer rows thus provide less magnetic field strength than provided by a center row of the magnets 35*a*. This concept can be quite valuable when optimizing high energy, i.e. greater than 25 MGO, magnets in a single-ended planar-magnetic transducer, in that the configuration can provide surprisingly more gain in efficiency for a given increase in magnetic material than what is expected. Normally, it is understood that, by increasing the magnetic energy in all the magnets in a transducer by 41% a 3 db increase in efficiency will be provided. It has been found, when just the central magnet 35*a* is doubled in energy level, a three db efficiency increase is available in a single-ended planar-magnetic transducer. This is an increase of only 20% of the total magnetic energy, or less than half the theoretically predicted amount, to achieve this level of efficiency increase. This is found to be the case when doubling the magnetic density and force of a central magnet when using a high energy magnetic structure for at least the central-most magnet. The explanation comes from the ability to easily double magnetic force with small high energy magnets combined with the greater responsive mobility of the central-most area of the diaphragm compared to the outermost, more excursion-constrained areas. Therefore, by organizing the magnetic force to be greatest in the center magnet 35*a* and having less energy in rows going outward toward the outermost magnets 35*d* and 35*e*, the best use of magnetic energy is provided. This can allow the cost of the magnets to be less for a given acoustic efficiency. And also, it is synergistic with the variable gap 31 approach discussed above.

Figure 21:
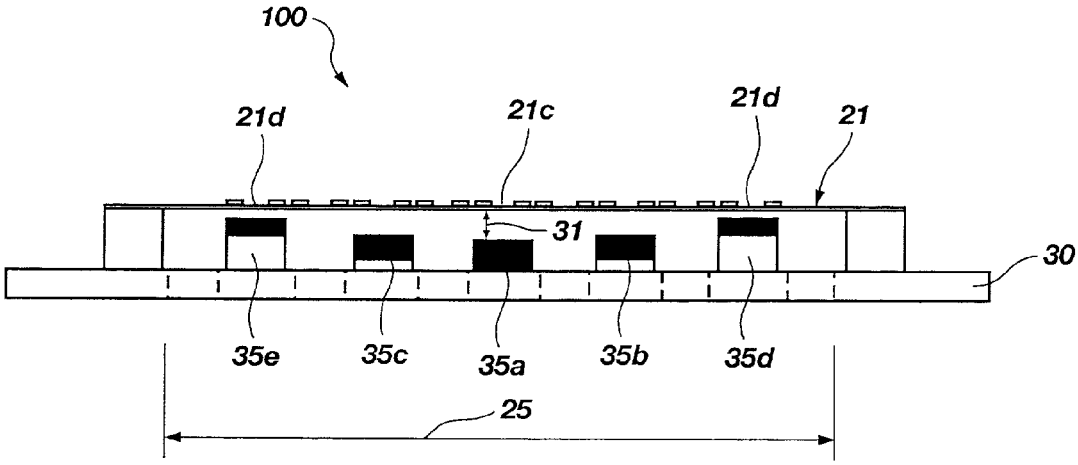
FIG. 21 is a schematic cross-sectional view of an embodiment of the invention with reducing magnet strengths and magnet-diaphragm gaps for magnets with distance away from a central magnet or center of symmetry.

This varying field strength approach can, of course, be used with different combinations of three or more magnets, and can be distributed in various ways. For example, in the illustrated embodiment the transducer 100 can be configured so that just the outermost magnets are of less energy, for example 3 central magnets 35*a–c* being of higher energy, and outer magnets 35*d,e* being of lower energy. With reference to FIGS. 18, 19, and 21, the concept can be applied in other combinations wherein all magnets other than the central magnet 35*a* can be of less energy according to some function of falling energy with distance from the central-most region of the transducer. An example is the combination of the concepts illustrated in FIGS. 18 and 19, as shown in FIG. 21. A falling magnetic force is utilized with greater lateral distances from the central-most magnet 35*a,* and also a closer diaphragm to magnet gap 31 is utilized at greater lateral distances from the central-most magnet 35*a*. This can be accomplished a number of ways, some of which are: i) using high energy, neodymium magnets in the central portion and lower energy magnets, such as ferrite magnets, at the outer regions; ii) using larger and/or deeper high energy magnets in the central region while using smaller and/or shallower magnets in the outer regions, with those in the outer region spaced closer to the diaphragm 21; iii) or some combination of the two approaches.

Alternatively, although the economical gains may not be as advantageous, the concept can be implemented by providing more elongated conductive runs 27 between central rows of magnets (i.e. more coil turns) and less conductive runs could be placed between outer most magnet rows to create greater forces in the center and lower forces towards the outside. This concept of varying the effective magnetic coupling can be combined with the foregoing concepts of varying the field strength and of varying the gap 31 distance as described, to optimize performance.

To reiterate, increasing magnetic energy in the central area or region and decreasing gap distance between the magnets and the diaphragm 21 at the outer vibratable diaphragm areas or regions can provide more acoustical efficiency, both in terms of energy use, and in cost of manufacture, for a given output. Moreover, even optimizing for the least amount of magnet cost expenditure, with high energy magnets and the design considerations discussed above, one can provide performance levels virtually unachievable with an equal magnetics all across the transducer. Thus, the potential reachable with this concept utilizing high energy magnets of greater than 25 MGO and even preferably greater than about 34 MGO, neodymium magnets is far superior than that of prior single-ended planar-magnetic transducers.

Figure 26:
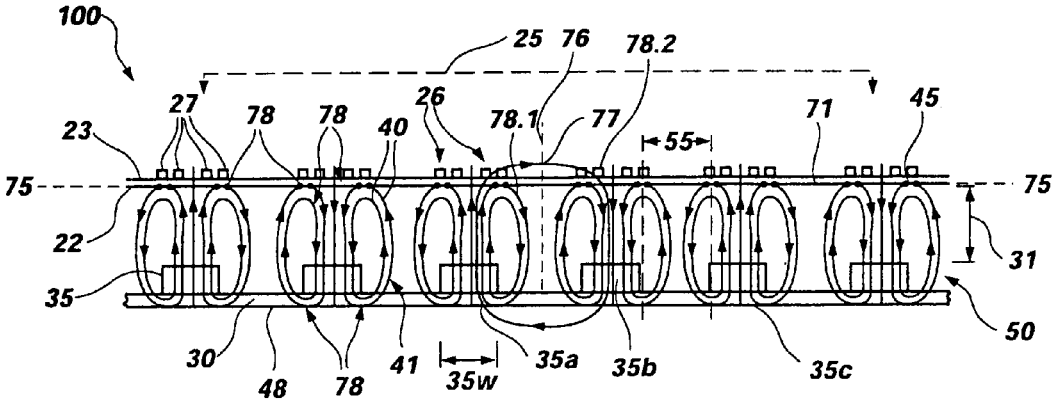

With reference to FIG. 26, when applying high energy magnetics to a single ended planar-magnetic transducer it has been found by the inventors that a different magnetic design approach than is taught in the prior art can be quite advantageous. This unique design approach is illustrated in FIG. 21 wherein a planar-magnetic transducer 100 comprising at least one thin film vibratable diaphragm 21, with a first surface side 22 and a second surface side 23, includes a predetermined active region 25 and the active region including predetermined conductive surface areas 26 for converting an input electrical signal into a corresponding acoustic output. The conductive surface areas 26 including elongate conductive paths 27 running substantially in parallel with said magnets 35*a* through 35*e*. A mounting support structure 30 is coupled to the magnetic structure 35 and the diaphragm 21 to capture the diaphragm, hold it in a predetermined state of tension and space it at predetermined distance 31 from the magnetic structure 35 adjacent one of the surface sides of the film diaphragm. The magnetic structure 35 includes at least three high energy, elongated magnet rows 35*a*, 35*b*, and 35*c*, placed adjacent and substantially parallel to each other with each magnet having a material energy density of greater than 25 mega Gauss Oersteds and more preferably greater than 34 MGO and comprising neodymium iron or another material of like capability in producing a magnetic field.

The mounting support structure 30, the diaphragm 21 and the at least three magnets of the magnetic structure 35 are cooperatively configured and positioned in predetermined spaced apart relationships. At least two of said high-energy magnets being adjacently positioned in a predetermined spaced-apart relationship 55 wherein adjacent poles of the adjacent magnets have non-shared, localized magnetic loops 40 represented by local loop field energy maxima 78 in a plane of the diaphragm 21 which are respectively greater than an energy level a shared energy maxima 71 at a central position between the adjacent poles and extending along a shared magnetic loop of the respective adjacent poles in the plane of the diaphragm 21. The planar-magnetic transducer 100 is operable as a single-ended planar-magnetic transducer.

It is found by the inventors that whereas prior art planar-magnetic loudspeakers have taught the placing of the magnets very close together to achieve a maximized shared loop (see 81 in FIG. 2) this practice can be substantially improved upon when adopting a proper use of high energy magnets in accordance with the invention. In spacing the rows of magnets in the invention so that the field strength applied at the diaphragm by the local loops above each magnet is of greater magnetic energy than the shared loop centered between the two high-energy magnets, a number of advantages are derived. First, a distributed field allows the use of fewer magnets while achieving much higher outputs than the prior art. The distribution of the conductive runs on the diaphragm 21 can be distributed more effectively to have less conductive area producing direct drive of the diaphragm at the point centered between the magnets 35. This redistribution of the conductive runs 27 of the conductive areas 26 on diaphragm 21 allows a favorable impedance for the total of the conductive region/areas 26 while also distributing the drive force to more effectively drive the active region 25 of diaphragm 21. For prior single-ended planar-magnetic loudspeakers known to the inventors to function in a reasonable manner they need to be designed in an almost opposite manner from this method of optimization and use very close magnet to magnet spacing to maximize the shared field strength at the center maxima 71 and concentrate the coil traces there.

Figure 22:
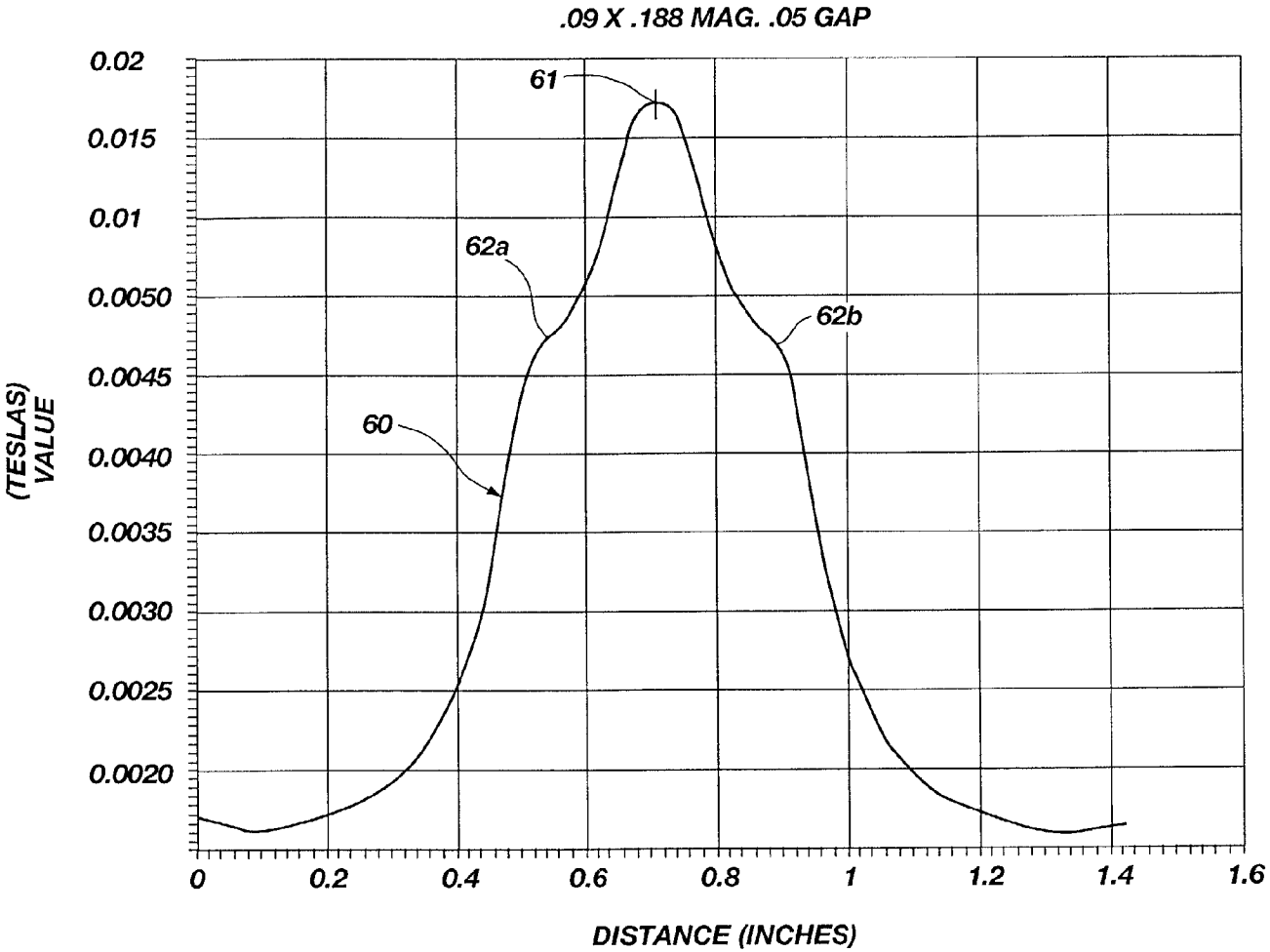
Fig. 22 (PRIOR ART)
FIG. 22 is a graphical plot of field strength at the diaphragm in Teslas vs. distance in inches across the magnet rows, and illustrates a maximized central shared magnetic energy approach of the prior art.
Figure 23:
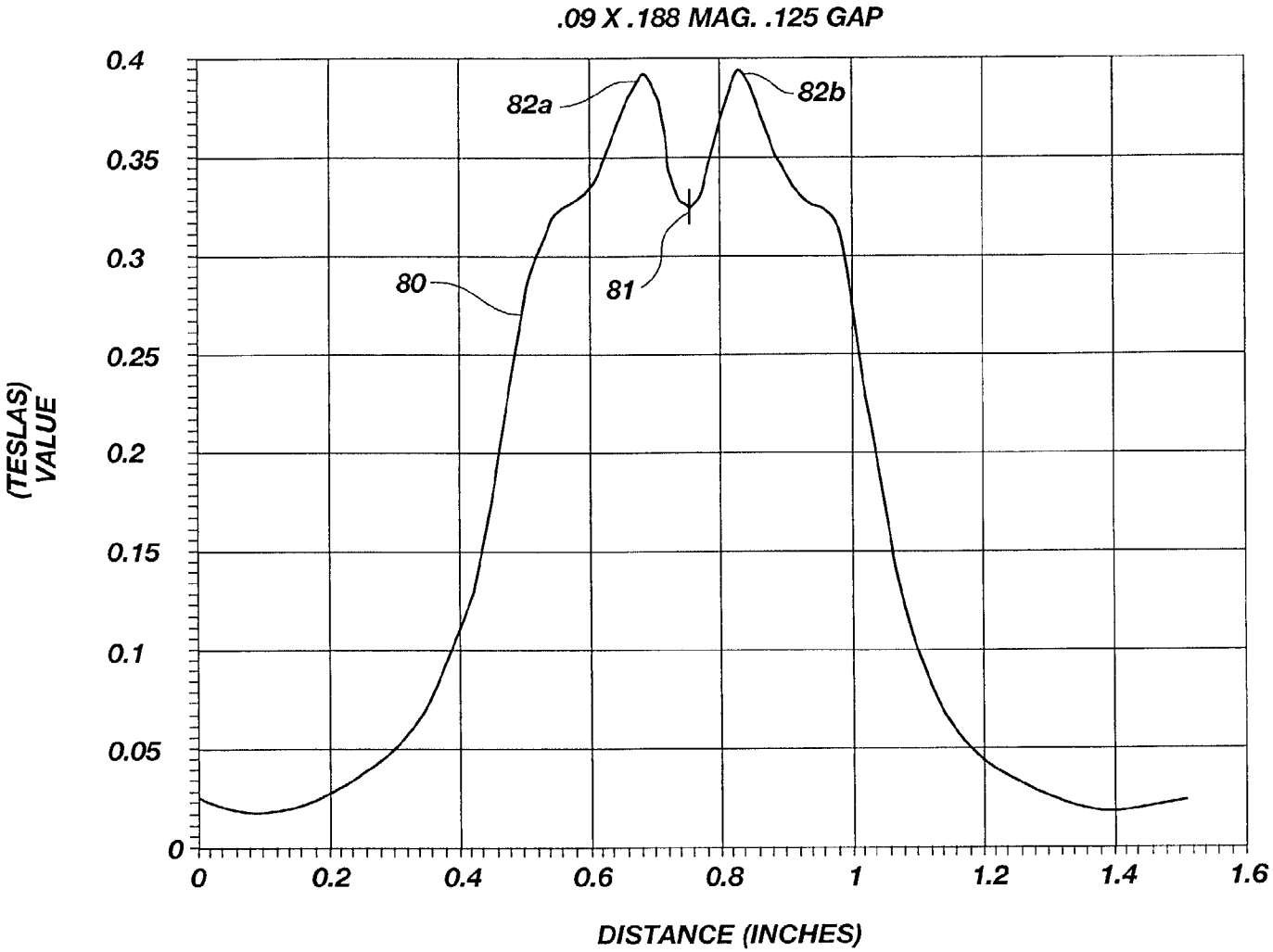
FIG. 23 is a graphical plot of field strength vs. distance, and illustrates that of an embodiment of the invention, which illustrates using magnet spacing to enhance local loops so as to be greater than the central shared magnetic energy.

Referring to FIGS. 22 and 23, The different approach to magnetic energy distribution can be seen in the magnetic force distribution plot (using Maxwell magnetic circuit analysis software from AnSoft) for a prior art magnet placement scheme (FIG. 22) relative to the magnetic force distribution arising from inventive placement in accordance with this disclosure (FIG. 23). Shown in FIG. 22 is a graphical representation of the magnetic field 60 between two magnets when configured as in the prior art with the vertical values in Teslas and the horizontal values in fractions of an inch. In this case with a fifty thousandths of an inch lateral gap between the two rows of magnets (less than a third the width of the magnet) it can be clearly seen that the "shared-loop" energy peak 61 has a maximum value of about 0.017 Tesla or 170 Gauss that would be available to the diaphragm conductors centered between the magnets on the plane of the diaphragm. It can be seen that the usable area is quite narrow. Also, the local loop energy maximums 62*a* and 62*b* over the inner edge of the magnets is much lower at 0.0047 Tesla or about 47 gauss. In a typical prior art configuration, depending on the type of ferrite magnet used, these energy levels would generally vary from less than 150 to about 900 gauss.

Shown in FIG. 23 is a graphical representation of the magnetic field 80 between two magnets configured in accordance with this disclosure, with the vertical values in Teslas and the horizontal values in fractions of an inch. In this case, with a lateral spacing of one hundred and eighty-eight thousandths of an inch lateral gap between the two rows of magnets (the same as the width of the magnet) it can be clearly seen that the "shared-loop" energy level 81 is a minima and has a value of about 0.325 Tesla or 3250 gauss. It can be seen that the usable area is quite broad and the local loop energy maximums 82*a* and 82*b* over the inner edge of the magnets is much greater at 0.39 or 3900 Gauss. This illustrates the inventive concepts of utilizing the neodymium magnet in an arrangement that facilitates much broader lateral energy interaction with the plane of the diaphragm 21 and with much greater force. This allows fewer magnets with greater spacing and provides a more even drive to the diaphragm 21 across its surface and more room for traces (coil turns) per magnet. The invention also provides a much greater portion of the driving force to the diaphragm 21 at locations more overtop the magnets; where, by conductor placement on the film, the diaphragm 21 can be loaded by the magnets over a wider area. Whereas the prior art configuration only drives the film diaphragm 21 at the points between the magnets, and must pull the diaphragm 21 along passively at points over the magnets where there is no conductor trace. This means the magnets must be spaced closer together. It was the inventor's realization of departure from this prior configuration in combination with use of high energy magnets, that enabled pursuing novel design directions in accordance with this disclosure that can have a further impact on the efficiency of the transducer.

With reference again to FIG. 26, a still further advantage of this method of magnet/conductor relative placement and field interaction optimization is the result of easing the strong interactive forces between the magnets 35a through 35e that can cause attractions that distort the mounting support structure 30 and interfere with the calibration of the critical tensioning of the diaphragm 21 as explained above. The approach, along with bracing and other structural approaches mentioned previously, also eases the difficulty of maintaining reliability of attachment of the magnets 35*a* through 35*e* to the mounting support structure 30. The proper spacing to enhance the local loop energy near each magnet, rather than enhance the shared loop energy centered between each pair of magnets, reduces the problematic interactive forces between the magnets and creates a more reliable, extended lifetime system. This reliability advantage combined with the performance advantages provide a significant advancement in the state of the art of single-ended planar-magnetic loudspeakers. Transducers in accordance with this disclosure allow the integration of high energy neodymium magnetics without attendant drawbacks they bring with them if installed in accordance with the prior art configuration discussed herein.

In the exemplary planar-magnetic transducer 100, high energy magnets 35 have respective local loop energy maxima 78, wherein the majority of local loop energy maxima in the plane of the diaphragm 21 have an average value which is greater than an average value of energy levels at the central such as a central position 76 between corresponding adjacent poles of the adjacent magnets 35*a* and 35*b*. Some preferred values for this optimization can be expressed as preferred values wherein the shared energy maxima centered at a point 76 between a pair of magnets 35*a* and 35*b* is no greater than 90 percent of the local loop energy maxima 78.1 and 78.2 nearer each magnet 35*a* and 35*b* respectively. Still further adjustments to magnet and field placement can be achieved wherein the shared energy maxima is no greater than 75 or 80 percent of the local loop energy maxima.

This affect can be defined wherein a predetermined distance between the local loop energy maxima points 78 for adjacent magnets 35*a* and 35*b* is approximately equal to a separation distance between the corresponding adjacent magnets 35*a* and 35*b*. In another embodiment optimization of this effect is wherein the predetermined distance between the local loop energy maxima 78 for adjacent magnets is at least seventy five thousandths of an inch. Other optimizations of this effect is wherein the predetermined distance between the local loop energy maxima 78 for adjacent magnets is at least ninety thousandths of an inch and at least one hundred and twenty five thousandths of an inch. Another embodiment of this inventive concept is defined wherein the predetermined distance between the local loop energy maxima 38 is at least 100 percent of the width 35*w* of one of the magnets 35*a*.

Another embodiment of this inventive concept is defined wherein the predetermined spaced apart relationship distance between any two of the at least three adjacent, high-energy magnets is at least seventy five thousandths of an inch. In some preferred embodiments the predetermined distance spaced apart relationship between any two of the at least three adjacent, high energy magnets is at least ninety thousandths of an inch or even at least one hundred and fifty thousandths of an inch.

In one embodiment at least three adjacent, high-energy magnets have common dimensions and the predetermined distance spaced apart relationship there-between is at least one half the width of one of the adjacent magnets. Further optimization embodiments can be wherein the same type of spacing is at least seventy percent of the width of one of the magnets or at least 100 percent of the width of one of the magnets.

For best performance when optimizing for greater local loop energy, it is generally desirable to also have the conductive area comprising elongated conductive paths 27, whether singular or in group runs of 2 or more, positioned so as to take maximum advantage of the local loop maxima. In one embodiment they can be centered over the local loops for maximum field force engagement with the magnetic fields from the magnetic structure 35.

The inventors have found that when applying local loop optimization, as compared with shared loops, an even more effective transducer can be made that is smaller than the prior art known to the inventors, in that it can have strong audio output down to a low audio frequency range while having the active diaphragm region 25 having an effective vibratable area of less than one hundred and fifty square inches. This holds at even substantially less than one hundred and fifty square inches in some embodiments. Whereas, prior single-ended planar-magnetic loudspeakers have generally been much greater in diaphragm active surface area than one hundred and fifty square inches, most being much greater than three hundred square inches, while still being less efficient over most of the operating range than a single-ended planar-magnetic transducer in accordance with this disclosure. The invented transducer can be of this smaller size and yet generate a high acoustic output having an upper audio bandwidth extending down to a low range audio frequency.

With reference now to FIG. 20, another area of needed advancement in single ended planar-magnetic transducers is that of improving the diaphragm 21 to achieve greater thermal change and heat tolerance, high dimensional stability, and low distortion. A common diaphragm material in prior single-ended planar-magnetic loudspeakers has been polyester thin films, also known under the trademark name Mylar®. A limitation of such single-ended planar-magnetic loudspeakers has been reliability due to thermal problems both with the adhesives used to attach the conductive regions 26 to the diaphragm 21, and with thermal limits of stability of the diaphragm 21 itself. Due to lower efficiency, prior systems tend to require very high power inputs to achieve significant acoustic output levels. Because of this, and the inherent thermal stability limits of such polyester thin films, prior diaphragms both had to be large, to disperse generated heat over a large area, lessening the thermal impact for any particular small part of the diaphragm 21, and more limited in maximum output for a given surface area. The inventors have found another thin-film material that has higher temperature tolerance capability, but apparently, has not been applied to single-ended planar-magnetic loudspeakers. The film material is polyamide, or Kapton™. This film has high-temperature capability and is dimensionally more stable than polyester, and in addition to conventional film materials, is useable in the transducers disclosed herein, particularly when relatively very high power applications require the highest possible thermal effects tolerance capability. Unfortunately, polyamide film does not have a high internal damping characteristic and therefore can generate higher distortion when incorporated as a thin film planar-magnetic diaphragm. Damping as disclosed herein can mitigate this undesirable trait to some extent.

In further searching for films having desirable qualities for diaphragm 21 application, and through extensive materials research, the inventors have found a material that has been available for at least five to ten years, but evidently has not as yet been applied to single ended planar-magnetic loudspeakers, even though there has been a long-felt need for improvements in this area. The inventors have found that the novel use of polyethylenenaphthalate film, trademarked as PEN™ or Kaladex™, in the diaphragm of single-ended planar-magnetic transducers has an enhanced thermal effects resistance and very good dimensional stability while having improved internal damping compared to other high temperature films, such as those of the polyamide variety. Through testing, PEN film has been found to have significantly reduced distortion relative to the polyamide films and increased thermal tolerance capability over polyester films. This allows for very high power uses, while maintaining lower distortion. It is well suited for use in planar-magnetic transducers that are much smaller than the prior art single ended planar-magnetic loudspeakers mentioned herein, while avoiding thermal problems, even though the thermal concentrations can be greater in a smaller device. The dimensional stability further enhances diaphragm tension stability over long periods of time. However, it must also be said that it has been found that with local peak optimization, devices in accordance with this disclosure generally operate at a favorable overall temperature that is not significantly greater, and can be less than prior configurations, even though they incorporate high-energy magnets.

A further advancement toward achieving higher performance is derived from advancing the methods and materials used in bonding the conductive regions 26 of the coil to the diaphragm 21. In prior devices there have been limitations due to the adhesives utilized. Undesirable traits, such as larger than desirable adhesive mass, thermal break down and letting go of conductor adhesion to the diaphragm film, UV breakdown, long curing time, and in some applications an undesirable interaction with acids used to remove unwanted portions of the conductive layer.

It has been found that the use of cross linked adhesives can offer substantial improvements in mitigation of the above-mentioned limitations. In particular, a low-mass high temperature polyurethane cross linked adhesive for bonding the conductive surface areas to the film diaphragm 21 is preferable. Some of the advantages are:

i) The adhesive material can be printed onto the film surface (rather than laminated) so the deposit thickness is approximately 0.000095" with the result being that there is negligible mass added to the diaphragm 21.

ii) The crosslinking provides nearly instantaneous curing which can be critical to a diaphragm coil conductor manufacturing processes, such as a print and etch process.

iii) The adhesive is very stable at the 300 degrees Fahrenheit temperatures that can accompany a de-metalization process during fabrication of the diaphragm conductive regions.

iv) The thermal performance of the adhesive exceeds that of most of the desirable films to be used as the base diaphragm 21 material.

v) The adhesive is unaffected by the acids that are used in some preferred processes to remove the unwanted metal layer areas. For these reasons it has been found that it is desirable with a single ended planar-magnetic transducer to included a low mass high temperature polyurethane cross linked adhesive for bonding the conductive surface areas 26 to the film diaphragm 21.

Another issue with single-ended planar-magnetic transducers is that the fields created by the currents in the diaphragm conductors 27 can under some circumstances modulate the magnetic field set up by the magnetic structure 35, so as to create nonlinearities in the operation of the transducer that can produce distortion. This problem can be even more noticeable in single-ended planar-magnetic transducer utilizing high-energy magnets. A way to stabilize the magnetic field to minimize this modulation and increase transducer response linearity, thereby lowering distortion from this cause is desirable.

It has been found that a way to mitigate this distortion, to further optimize the use of high energy magnets in a single ended planar-magnetic transducer, is to apply the use of a conductive shorting sheet placed interlaced between the rows of magnets distanced at least the gap distance 31 from diaphragm 21. This can be formed of copper or another non-magnetic conductive material. This structure can allow the linearity of the magnetic field in a single-ended system to be more comparable with the magnetic field of more complex, but field-symmetric, double ended or push-pull planar-magnetic loudspeaker.

Returning to FIG. 12, and the discussion of bracing the magnetic structure, if the structure is implemented using at least one electrically conductive sheet structure 52*c* with acoustically transparent areas 53*a* such that said sheet structure 52*c* has at least a surface area 53*s* placed between at least two rows of said multiple rows of magnets 35*a* and 35*b* and preferably interlacing in between all the rows of magnets 35*a*, 35*b* and 35*c*, it will mitigate the non-linearity from this cause. The plate may also have portions extending outside of the outside magnets 35*b* and 35*c*, and can serve to brace the structure 30 at spacing portions 30*a* and b (FIG. 11), to reduce diaphragm tension changes from creeping deformation of the structure over time as discussed above.

Returning to the issue of compatibility with other speakers in an audio system, Another problem that has plagued prior single ended planar-magnetic loudspeakers, is poor magnetic coupling that has caused underdamped and otherwise poor amplitude response, and ringing at the fundamental resonant frequency, in the lowest frequency range of operation. Besides compromising the audible performance of the transducer itself in this frequency range, a still further problem has been that single ended planar-magnetic loudspeakers have had trouble integrating smoothly with woofer systems that can effectively handle the lowest frequencies as discussed above. Because of the underdamped quality of prior single ended planar-magnetic speakers the woofers tend to sound disjointed and separate from the planar transducer rather than blending seamlessly as desired. With the advent of home theater surround sound systems, the application of woofer systems is becoming very standard as a part of these systems, adding impressive performance improvements. The inability to effectively integrate with these woofer systems has kept prior art single ended planar-magnetic loudspeaker from participating very effectively in state-of-the-art expressions of surround-sound or stereo systems that incorporate a separate woofer (sometimes called sub woofer).

The effective application of high energy neodymium magnets can provide a surprisingly effective solution to the above stated limitation of prior art single ended planar-magnetic loudspeakers. With reference to FIGS. 4, 18, 19 and 21 using the high-energy, such as neodymium, magnets, and setting the gap 31 at a center maximum to less than one millimeter, better low frequency range response can be obtained. It can be preferable when desiring an increased ability to produce more controlled output at or near the resonant frequency, or to smooth the response through the region of the resonant frequency for more seamlessly interaction when crossing into a low frequency woofer system, to reduce the predetermined gap at its centered maximum to less than 0.75 millimeter or even less than 0.5 millimeter. It has been found that in addressing this problem it is preferred that magnets be of at least 35 MGO or more.

When applying the above-stated method or enhancement to a single ended planar-magnetic transducer, the transducer can be integrated effectively with a woofer system with substantially improved results, allowing this type of loudspeaker to finally participate effectively in what has been for over ten years a rapidly growing area for loudspeaker use that has seen very little participation from single ended planar-magnetic loudspeakers.

It is a significant and unexpected advantage of applying high energy magnetics of greater than 25 MGO or preferably 35 MGO or more in accordance with the invention, that it can provide greater large signal output without the usual over-excursion problems of prior single-ended designs. In fact, it is surprising that by decreasing the magnetic gap 31, over the central portion of the diaphragm 21 of a single ended planar-magnetic transducer 100, that not only the efficiency and damping improves, but also the large signal output capability increases. The prior approach was to expand the magnetic gap 31 so as to allow greater diaphragm 21 movement to achieve greater acoustic outputs. In the inventive system disclosed herein, a decrease of the gap from the 1 millimeter recommended previously in the prior art, to lesser values, reducing it by at least 25% to 50%, actually increases the damping and control of the diaphragm 21. Large signal capabilities are surprisingly increased; and the problem of the diaphragm 21 striking the magnet structure 35 is decreased for louder acoustic outputs over the vast majority of the operating range. This low frequency control improves the sound quality, the integration ability with woofer systems and allows greater overall system output and efficiency. This can also allow reduction in the required diaphragm 21 area of a single ended planar-magnetic transducer for the same sound pressure level as discussed in detail above. And this mitigates one of the bigger weaknesses of most prior single-ended planar-magnetic loudspeakers, which are, by necessity, typically more than about 300 square inches in diaphragm 21 area as discussed above. Incorporating features of the present invention can provide high performance transducers of less than 150 square inches of active diaphragm area 25 and a fundamental resonant frequency, and the attendant potential low frequency range, down to frequencies below four hundred Hertz. Again, as discussed in detail, above, because of the effectiveness of this method of improvement the diaphragm area can be further reduced to less than 100 square inches or even less than 30 square inches. It can also be applied such that the low frequency range is operable down to less than 800 Hz and the gap 31 is reduced down to less than 0.5 millimeters and active diaphragm area 25 is less than ten square inches.

Another significant improvement from the proper application of high energy magnets to a single ended planar-magnetic transducer is the increase in efficiency and therefore reduction in power requirements allowing for the first time high acoustic outputs in a smaller size with out prematurely reaching thermal limits. It also allows these improvements while saving wasteful power usage required in prior devices. Looking at it another way, more power, if needed, can be applied in creating a much higher dynamic range, and greater acoustic output. Also, embodiments disclosed herein can be more reliable, and smaller, single ended planar-magnetic device than was possible previously.

Figure 24:
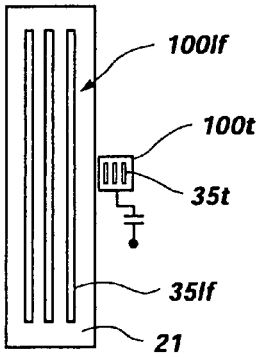
FIG. 24 is a front face view of a device in accordance with one embodiment of the invention, including a low-frequency transducer and a high-frequency transducer.
Figure 25:
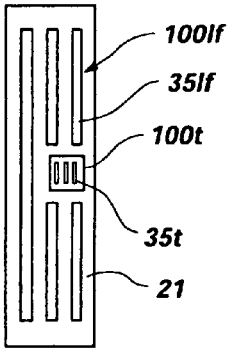
FIG. 25 is a variation of the device of FIG. 24, wherein a high-frequency transducer is incorporated in the structure of a lower-frequency transducer, the diaphragm of which is shared in one embodiment and in another is separate and is positioned on the rear of the device, in the position shown from the front in the figure; and, FIG. 26 is a schematic cross-sectional view of an embodiment of the invention illustrating magnet spacing to enhance local magnetic loops more than a shared central magnetic energy.

Turning now to FIGS. 24 and 25, while a transducer in many embodiments disclosed above can produce a very wide bandwidth without the requirement of a separate device for operating into the very highest frequencies of the treble/tweeter range, in some embodiments the performance can be improved, particularly in dispersion of the upper frequencies, by adding a smaller tweeter embodiment 100*t* of the invention combined with a larger low frequency range embodiment 100*lf* of the invention. Embodiments disclosed above can further be optimized to produce a highly effective single-ended planar-magnetic tweeter device that is smaller, more efficient, and of substantially wider bandwidth than prior single ended planar-magnetic loudspeaker designs for higher frequencies. By scaling the embodiment to an approximately 2" by 2" transducer, the resonant frequency can still be below 1 kHz, and below even 600 Hz is possible. The high-frequency bandwidth can extend to beyond 30 kHz, and even beyond 40 or 50 kHz is possible. This extension in bandwidth is maintained while also producing a sensitivity of 87 to over 92 dB while at the same time having less than one tenth the surface area of prior single ended planar-magnetic tweeters known to the inventors, of which the smallest tend to be on the order of over 30" long by 1.25" wide and have sensitivities of 86 dB or less.

In more detail and with reference to FIG. 4, for example, a tweeter embodiment can have an active diaphragm area 25 on the order of 1.5" by 2.25", and the magnet structure 35 to diaphragm gap 31 can be less than 0.75 mm, preferably in the 0.20 to 0.50 mm range. This device is valuable in many applications where there has not been a single-ended planar-magnetic device effectively able to function in the past, such as in automobile sound systems, multi-media, and home theater and now home stereo systems where wide-band Super Audio CDs are capable of 50 kHz bandwidths are demanding more extended range tweeters. Examples of the embodiments of FIGS. 24 and 25 can operate from below 500 Hz to over 50 kHz providing exemplary performance in a device that can also have the advantage of low cost. This surprising high frequency response enables application of planar magnetic speakers as a part of a parametric speaker system using ultrasonic emissions to generate audio output. This application is the subject matter of separate patent applications, U.S./PCT Serial Nos. 09/159,442 and 09/787,972 and continuations thereof, which are hereby incorporated by reference, and will not be discussed in detail herein.

Again with reference to FIG. 24 at least one transducer 100*t* can be optimized for higher frequencies and attached to at least one transducer 100*lf* which is optimized to operate down to a lower frequency than that of the first transducer, thereby forming a multi way loudspeaker with the multi way loudspeaker further including at least a high-pass crossover filter (not shown) and can include a crossover network for driving the first and second transducer at their respective frequency ranges. A separate power amplifier (not shown) adapted to provide just the high frequency signal to the tweeter 100*t* can be provided. There may also be a low pass filters (not shown) applied to the lower frequency transducer 100*lf* and a separate amplifier for the lower frequency transducer. The electronic implementation of the scheme can be in one of the various other ways known to those skilled in the art.

With reference to FIG. 25, the high frequency tweeter portion of the transducer 100*t*, can be integrated into the footprint of the larger low frequency portion 100*lf*. In such a single-ended planar-magnetic transducer the tweeter area utilizes a portion of the diaphragm 21, and the smaller tweeter magnetic structure 35*t* is on the same side of the device as the larger low-frequency magnetic structure 35*lf*. In another embodiment, the tweeter portion 100*t* can have its own separate diaphragm placed on the opposite face (behind the device in the figure) from the larger diaphragm 21.

From the forgoing it will be appreciated that many problems and solutions in accordance with the invention are involved in the incorporation of higher energy magnets in single-ended planar magnetic transducers. Particularly, incorporation of neodymium magnets 40 or more times stronger than magnets previously used in single-ended planar-magnetic loudspeakers which have not been able to be utilized even though they have been available for over ten years. The over forty years of attempts at effective applications of single ended planar-magnetic transducers have been substantially unsuccessful commercially, particularly in the large-growth areas of surround-sound and automotive applications where the high outputs and smaller sizes in flat panels have been long felt needs but heretofore unavailable. The invention as exemplified by the disclosed embodiments has not only solved the problems of incorporation of high energy neodymium magnets in a single ended planar-magnetic transducer, it has opened many ways to enhance previously untapped potential of single-ended planar magnetic loudspeaker architecture. That architecture can now challenge the long-entrenched dynamic cone-type loudspeaker with both performance advantages and thin panel packaging advantages. Besides offering a competitive challenge to the established technology of dynamic cone speakers, the invention offers new dimension of performance over prior attempts at flat-panel planar loudspeaker designs.

Those skilled in the art in possession of this disclosure may now make numerous other modifications of, and departures from, the specific apparatus and techniques herein disclosed without departing from the inventive concepts. It is to be understood that the above-described embodiments and alternative arrangements are only illustrative of the application of the principles of the present invention. Thus, while the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts set forth herein within the spirit and scope of the invention. The disclosure set forth above is not intended to be limiting of the scope of the invention, which is defined by the appended claims.

The invention claimed is:

1. A planar-magnetic transducer comprising:

at least one thin film vibratable diaphragm with a first surface side and a second surface side, including a predetermined active region, said predetermined active region including a predetermined conductive surface area for converting an input electrical signal into a corresponding acoustic output;

primary magnetic structure including at least three elongated magnets placed adjacent and substantially parallel to each other with said magnets being of high energy and each having an energy product of greater than 25 mega Gauss Greased (MGO) which results in strong interaction between adjacent magnets; and a mounting support structure coupled to the primary magnetic structure and the diaphragm to capture the diaphragm, hold it in a predetermined state of tension and space it at a predetermined distance from the primary magnetic structure adjacent one of the surface sides of the diaphragm; said conductive surface area including elongate conductive paths running substantially parallel to said magnets;

the mounting support structure, the at least three magnets of the primary magnetic structure, and the diaphragm having coordinated compositions and being cooperatively configured and positioned in predetermined spaced apart relationships wherein (i) the mounting support structure stabilizes the diaphragm in a static configuration at the predetermined tension which remains stable over and between extended periods of use, despite occurrence of dynamic conditions in response to extreme high energy forces driving the diaphragm to audio output, and (ii) the high energy magnetic forces interacting between the at least three magnets do not interfere with the predetermined tension of the diaphragm;

said planar-magnetic transducer being operable as a single-ended planar-magnetic transducer.

2. A planar-magnetic transducer as set forth in claim 1 wherein the high energy magnets comprise neodymium.

3. A planar-magnetic transducer as set forth in claim 1 wherein the high energy magnets are neodymium magnets with an energy rating of at least 34 MGO.

4. A planar-magnetic transducer as set forth in claim 1, wherein the at least one thin film vibratable diaphragm includes a predetermined active region of less than 150 square inches, said predetermined active region including a predetermined conductive surface area for converting the input electrical signal into the corresponding acoustic output having an upper audio bandwidth extending down to a low range audio frequency.

5. A planar-magnetic transducer as set forth in claim 4 wherein said transducer diaphragm has a vibratable area and a fundamental resonant frequency representing approximately the lowest potential cutoff frequency of operation, the vibratable area and lowest cutoff frequency of operation of the planar-magnetic transducer falling into the unique range of $$Fr<(2000/\sqrt{A})$$

wherein (Fr) equals the fundamental resonant frequency of the transducer in Hertz and (A) equals the vibratable area of the transducer diaphragm in square inches.

6. A planar-magnetic transducer as set forth in claim 4 wherein:

said transducer diaphragm has a vibratable area and a centered gap between the magnetic structure and the diaphragm measured at the center of the diaphragm, said transducer has a fundamental resonant frequency representing approximately the lowest potential cutoff frequency of operation, and the vibratable area and lowest cutoff frequency of operation of the planar-magnetic transducer are in the range of $$Fr<(1500/\sqrt{A}\ G)$$

wherein (Fr) equals the fundamental resonant frequency of the transducer in Hertz and (A) equals the vibratable area of the transducer diaphragm in square inches and (G) equals the magnet to diaphragm gap measured in millimeters at the center of the transducer diaphragm.

7. A planar-magnetic transducer as set forth in claim 4 wherein:

said transducer diaphragm has a vibratable area and a centered gap between the magnetic structure and the diaphragm measured at the center of the diaphragm, said transducer has a fundamental resonant frequency representing approximately the lowest potential cutoff frequency of operation, and the vibratable area and lowest cutoff frequency of operation of the planar-magnetic transducer are in the range of $$Fr<(1000/\sqrt{A}\ G)$$

wherein (Fr) equals the fundamental resonant frequency of the transducer in Hertz and (A) equals the vibratable area of the transducer diaphragm in square inches and (G) equals the magnet to diaphragm gap measured in millimeters at the center of the transducer diaphragm.

8. A planar-magnetic transducer as set forth in claim 4 wherein:

said transducer diaphragm has a vibratable area with a length and a width dimension wherein the width dimension is the lesser of the length and width dimensions, said transducer has a fundamental resonant frequency representing approximately the lowest potential cutoff frequency of operation, and the width of the vibratable area and lowest cutoff frequency of operation of the planar-magnetic transducer are in the range of $$Fr<(1000/W)$$

wherein (Fr) equals the fundamental resonant frequency of the transducer in Hertz and (W) equals width dimension of the vibratable area of the transducer diaphragm in inches.

9. A planar-magnetic transducer as set forth in claim 4 wherein:

said transducer diaphragm has a vibratable area with a width dimension less than a length dimension, the transducer further has a gap dimension between the magnetic structure and the diaphragm and said gap dimension measured at the center of the diaphragm, said transducer has a fundamental resonant frequency representing approximately the lowest potential cutoff frequency of operation, and the width of the vibratable area and lowest cutoff frequency of operation of the planar-magnetic transducer are in the range of Fr<(800/W)/G;

wherein (PR) equals the fundamental resonant frequency of the transducer in Hertz and (W) equals width dimension of the vibratable area of the transducer diaphragm in inches and (G) equals the magnet to diaphragm gap measured in millimeters at the center of the transducer diaphragm.

10. A planar-magnetic transducer as set forth in claim 4 wherein the predetermined active diaphragm region has a total surface area of less than 100 square inches.

11. A planar-magnetic transducer as set forth in claim 4 wherein the predetermined active diaphragm region has a total surface area of less than 80 square inches.

12. A planar-magnetic transducer as set forth in claim 4 wherein the predetermined active diaphragm region has a total surface area of less than 60 square inches while having an operating resonant frequency of less than 400 Hz.

13. A planar-magnetic transducer as set forth in claim 12 having an operating resonant frequency of less than 300 Hz.

14. A planar-magnetic transducer as set forth in claim 4 wherein the predetermined active diaphragm region has a total surface area of less than 20 square inches while having an operating resonant frequency of less than 400 Hz.

15. A planar-magnetic transducer as set forth in claim 14 having an operating resonant frequency of less than 300 Hz.

16. A planar-magnetic transducer as set forth in claim 4 wherein the predetermined active diaphragm region has a total surface area of less than 9 square inches while having an operating resonant frequency of less than 900 Hz.

17. A planar-magnetic transducer as set forth in claim 4 further comprising a plurality of said transducers inter coupled as a line source of serially mounted transducers which form a loudspeaker taller than one transducer.

18. A planar-magnetic transducer as set forth in claim 1 further comprising at least one spacer structure positioned and abutting between at least two adjacent high energy magnets to eliminate the effect of magnetic attraction forces from potentially reducing the predetermined distance between at least two of the high energy magnets so the high energy magnetic forces do not interfere with the predetermined tension of the diaphragm.

19. A planar-magnetic transducer as set forth in claim 1 wherein the predetermined distance between at least two of the adjacent high energy magnets is at least seventy five thousandths of an inch.

20. A planar-magnetic transducer as set forth in claim 1 wherein the predetermined distance between at least two of the adjacent high energy magnets is at least ninety thousandths of an inch.

21. A planar-magnetic transducer as set forth in claim 1 wherein the predetermined distance between at least two of the adjacent high energy magnets is at least one hundred and fifty thousandths of an inch.

22. A planar-magnetic transducer as set forth in claim 1 wherein at least two of the adjacent high energy magnets have common dimensions and the predetermined distance therebetween is at least one half the width of one of the magnets.

23. A planar-magnetic transducer as set forth in claim 1, wherein the predetermined distance between the at least two high energy magnets is at least seventy percent of the width of one of the at least two adjacent magnets.

24. A planar-magnetic transducer as set forth in claim 1, wherein the predetermined distance between at least two of the adjacent high energy magnets is at least 100 percent of the width of one of the at least two adjacent magnets.

25. A planar-magnetic transducer as set forth in claim 1, wherein the mounting support stricture further includes forward support structure coupled to the mounting support structure and extending across and forward of the diaphragm to eliminate the effect of combined diaphragm tension forces and magnetic attraction forces from potentially reducing the predetermined distance between the adjacent magnets.

26. A planar-magnetic transducer as set forth in claim 1 further comprising:

a rigid covering structure attached to the mounting support structure and having open areas and closed areas which substantially cover one of said first or second surface sides of the diaphragm, the primary magnetic structure being attached to the mounting support structure and mounted over the first surface side of the diaphragm, said covering structure open areas having acoustic transparency.

27. A planar-magnetic transducer as set forth in claim 26 wherein said rigid covering structure is ferrous composition and provides magnetic shielding.

28. A planar-magnetic transducer as set forth in claim 27 wherein said rigid covering structure braces the transducer against support structure flexing and very high magnetic forces caused by the adjacently mounted high energy magnets and supports the maintenance of predetermined diaphragm tension calibration.

29. A planar-magnetic transducer as set forth in claim 1 wherein a long term viscous material is applied along at least a portion of a periphery of the vibratable diaphragm and configured to provide damping properties to the diaphragm.

30. A planar-magnetic transducer as set forth in claim 29 wherein application of said viscous material is limited to an area outside of the conductive surface area but extends into the active region of the diaphragm.

31. A planar-magnetic transducer as set forth in claim 30 wherein application of said viscous material is limited to an area of the diaphragm outside and proximate to a last row of magnets on each side of the primary magnetic structure but extends into the active region of the diaphragm.

32. A planar-magnetic transducer as set forth in claim 31, wherein said viscous material is a solvent based polyurethane compound.

33. A planar-magnetic transducer as set forth in claim 1 wherein:

said diaphragm has a central region and lateral regions that are a distance away from said central region, said primary magnetic structure has central region magnets and lateral magnets that are spaced away from said central region magnets, the predetermined spaced-apart relationship of the diaphragm from the magnets of the primary magnetic structure being greater at the central region of the diaphragm which is positioned over at least one central magnet than at the lateral diaphragm regions which are positioned over at least one lateral magnet.

34. A planar-magnetic transducer as set forth in claim 1 wherein at least a first of the transducers is optimized for higher frequencies and attached to at least a second of the transducers which is optimized to operate down to a lower frequency than that of said first transducer thereby forming a multi way loudspeaker, said multi way loudspeaker further including at least a high pass crossover filter for driving said first transducer.

35. A planar-magnetic transducer comprising:

at least one thin film vibratable diaphragm with a first surface side and a second surface side, including a predetermined active region, said predetermined active region including a predetermined conductive surface area for converting an input electrical signal into a corresponding acoustic output;

a magnetic structure including at least three elongated magnet rows placed adjacent and substantially parallel to each other with said magnets each being of high energy product greater than 25 mega Gauss Quested (MGO); and a mounting support structure coupled to the primary magnetic structure and the diaphragm to capture the diaphragm, hold it in a predetermined state of tension and space it at a predetermined distance from the primary magnetic structure adjacent one of the surface sides of the film diaphragm;

said conductive surface area including elongate conductive paths running substantially in parallel with said magnets;

the mounting support structure, the diaphragm and the at least three magnets of the primary magnetic structure having coordinated compositions and being cooperatively configured and positioned in predetermined spaced apart relationships wherein (i) the mounting support structure stabilizes the static and dynamic relationship between the diaphragm and the primary magnetic structure over and between extended periods of use and (ii) concurrently resists the high energy magnetic forces interacting between the at least three magnets which would otherwise interfere with the predetermined tension of the diaphragm;

said planar-magnetic transducer being operable as a single-ended planar-magnetic transducer.

36. A planar-magnetic transducer as set forth in claim 35 wherein the high energy magnets comprise neodymium.

37. A planar-magnetic transducer as set forth in claim 35 wherein the high energy magnets are neodymium magnets with an energy rating of at least 34 MGO.

38. A planar-magnetic transducer comprising:

at least one thin film vibratable diaphragm with a first surface side and a second surface side, including a predetermined active region, said predetermined active region including a predetermined conductive surface area for converting an input electrical signal into a corresponding acoustic output;

a mounting support structure coupled to the primary magnetic structure and the diaphragm to capture the diaphragm, hold it in a predetermined state of tension and space it at a predetermined distance from the primary magnetic structure adjacent one of the surface sides of the film diaphragm; and primary magnetic structure including at least three high energy, elongated magnets placed adjacent and substantially parallel to each other with each magnet having an energy product of greater than 25 mega Gauss Oersteds (MGO);

said conductive surface area including elongate conductive paths running substantially in parallel with said magnets;

the mounting support structure, the diaphragm and the at least three magnets of the primary magnetic structure being cooperatively configured and positioned in predetermined spaced apart relationships;

at least two of said high energy magnets being adjacently positioned in a predetermined spaced apart relationship wherein adjacent poles of the adjacent magnets have non shared, localized magnetic loops represented by local loop energy maxima in a plane of the diaphragm which are respectively greater than a shared energy maxima at a central position between the adjacent poles and extending along a shared magnetic loop of the respective adjacent poles in the plane of the diaphragm;

said planar-magnetic transducer being operable as a single-ended planar-magnetic transducer.

39. A planar-magnetic transducer as set forth in claim 38, wherein the predetermined active region has a total surface area of less than 150 square inches, yet generates a high acoustic output having an upper audio bandwidth extending down to a low range audio frequency.

40. A planar-magnetic transducer as set forth in claim 38, further comprising a plurality of adjacently positioned high energy magnets having respective local loop energy maxima, wherein the majority of local loop energy maxima in the plane of the diaphragm have an average value which is greater than an average value of energy levels at the central positions in the plane of the diaphragm between corresponding adjacent poles of the adjacent magnets.

41. A planar-magnetic transducer as set forth in claim 38, wherein the shared energy maxima is no greater than 90 percent of the local loop energy maxima.

42. A planar-magnetic transducer as set forth in claim 38, wherein the shared energy is no greater than 80 percent of the local loop energy.

43. A planar-magnetic transducer as set forth in claim 38, wherein the shared energy is no greater than 75 percent of the local loop energy maxima.

44. A planar-magnetic transducer as set forth in claim 38, wherein a predetermined distance between the local loop energy maxima for adjacent magnets is approximately equal to a separation distance between the corresponding adjacent magnets.

45. A planar-magnetic transducer as set forth in claim 44, wherein the predetermined distance between the local loop energy maxima for adjacent magnets is at least seventy five thousandths of an inch.

46. A planar-magnetic transducer as set forth in claim 45, wherein the predetermined distance between the local loop energy maxima is at least ninety thousandths of an inch.

47. A planar-magnetic transducer as set forth in claim 38 wherein the predetermined distance between the local loop energy maxima is at least 100 percent of the width of the magnets.

48. A planar-magnetic transducer as set forth in claim 38 wherein the predetermined spaced apart relationship between any two of the at least three adjacent, high energy magnets is at least seventy five thousandths of an inch.

49. A planar-magnetic transducer as set forth in claim 38 wherein the predetermined spaced apart relationship between any two of the at least three adjacent, high energy magnets is at least ninety thousandths of an inch.

50. A planar-magnetic transducer as set forth in claim 38 wherein the predetermined spaced apart relationship between at least two of the at least three adjacent, high energy magnets is at least one hundred and fifty thousandths of an inch.

51. A planar-magnetic transducer as set forth in claim 38 wherein the at least three adjacent, high energy magnets have common dimensions and the predetermined spaced-apart relationship between at least two of said adjacent magnets is at least one half the width of one of the adjacent magnets.

52. A planar-magnetic transducer as set forth in claim 38, wherein the predetermined spaced-apart relationship between at least two of the at least three adjacent, high-energy magnets is at least seventy percent of the width of one of said adjacent magnets.

53. A planar-magnetic transducer as set forth in claim 38 wherein the predetermined spaced-apart relationship between at least two of the at least three adjacent, high-energy magnets is at least 100 percent of the width of one of said adjacent magnets.

54. A planar-magnetic transducer as set forth in claim 38 wherein the high energy magnets are neodymium magnets with an energy rating of at least 34 MGO.

55. A planar-magnetic transducer comprising:

at least one thin film vibratable diaphragm with a first surface side and a second surface side, including a predetermined active region, said predetermined active region including a predetermined conductive surface area for converting an input electrical signal into a corresponding acoustic output;

primary magnetic structure including at least three elongated magnets placed adjacent and substantially parallel to each other with at least one of said magnets being of high energy with each having an energy product of greater than 25 mega Gauss Greased (MGO); and a mounting support structure coupled to the primary magnetic structure and the diaphragm to capture the diaphragm, hold it in a predetermined state of tension and space it at a predetermined distance from the primary magnetic structure adjacent one surface side of the film diaphragm;

said conductive surface area including elongate conductive paths running substantially in parallel with said magnets;

any of the at least three adjacent magnets being oriented to be of opposite polarity orientation in relation to an adjacent magnet;

said primary magnetic structure having at least three adjacent rows of side by side magnets with at least an outer two rows of the at least three rows of magnets providing less magnetic field strength through the conductive surface area of the diaphragm than provided through the conductive surface areas of the diaphragm by a center row of the magnets;

said planar-magnetic transducer operating as a single-ended planar-magnetic transducer.

56. A planar-magnetic transducer as set forth in claim 55 including at least five adjacent rows of magnets with at least two outer rows of said five rows of magnets providing less magnetic field strength through the conductive surface area of the diaphragm than provided through the conductive surface area of the diaphragm by a center row of magnets.

57. A planar-magnetic transducer as set forth in claim 55 wherein the primary magnetic structure includes neodymium magnets with an energy rating of at least 34 MGO.

58. A planar-magnetic transducer as set forth in claim 55 wherein:

said diaphragm has a central region and lateral regions that are a distance away from said central region, said primary magnetic structure has central region magnets and adjacent lateral magnets that are spaced away from said central region magnets, the predetermined spaced apart relationship of the diaphragm from the magnets of the primary magnetic structure being greater at a central region of the diaphragm over at least one central magnet than at the lateral regions over at least one lateral magnet.

59. A planar-magnetic transducer comprising:

at least one thin film vibratable diaphragm with a first surface side and a second surface side, including a predetermined active region, said predetermined active region including predetermined, elongate conductive surface areas formed of a plurality of conductive elements for converting an input electrical signal into a corresponding acoustic output;

a mounting support structure coupled to the primary magnetic structure and the diaphragm to capture the diaphragm, hold it in a predetermined state of tension and space it at a predetermined distance from the primary magnetic structure adjacent one of the surface sides of the film diaphragm; and primary magnetic structure including at least three high energy, elongated magnets placed adjacent and substantially parallel to each other with each magnet having an energy product of greater than 25 mega Gauss Oersteds (MGO);

at least two of said high energy magnets being adjacently positioned in a predetermined spaced apart relationship wherein adjacent poles of the adjacent magnets have non shared, localized magnetic loops represented by local loop energy maxima as well as shared magnetic loops between the respective adjacent poles of the high energy magnets;

said conductive surface area running substantially parallel to said magnets and more proximate to the local loops of the high energy magnets than to a center point of the shared magnetic loops between the adjacent magnets;

said planar-magnetic transducer being operable as a single-ended planar-magnetic transducer.

60. A transducer as set forth in claim 59, wherein the conductive elements are substantially parallel to the elongated magnets and the conductive surface areas are most proximate to the respective local loop energy maxima associated with an adjacent magnet.

61. A planar-magnetic transducer as set forth in claim 59 wherein the high energy magnets are neodymium magnets with an energy rating of at least 34 MGO.

62. The transducer of claim 59, wherein the respective conductive surface areas are approximately centered over the local loops of adjacent high energy magnets.

* * * * *